US005237943A

United States Patent [19]

Klein et al.

[11] Patent Number: 5,237,943

[45] Date of Patent: Aug. 24, 1993

[54] MANIPULATING AND SEWING TWO TROUSER PORTIONS HAVING RIM STRIPS TO A ZIPPER AND APPARATUS USED THEREIN

[75] Inventors: Michael Klein, Bielefeld, Fed. Rep. of Germany; Benny Lapp, Vejle; Ole Nielsen, Herning, both of Denmark

[73] Assignee: Dürkopp Adler AG, Fed. Rep. of Germany

[21] Appl. No.: 785,503

[22] Filed: Oct. 30, 1991

[30] Foreign Application Priority Data

Nov. 3, 1990 [DE] Fed. Rep. of Germany ..... 4034999

[51] Int. Cl.[5] ..... D05B 3/12; D05B 21/00; D05B 35/06; A44B 19/34

[52] U.S. Cl. ..... 112/265.2; 112/104; 112/114; 112/121.15; 112/147

[58] Field of Search ..... 112/104, 152, 121.12, 112/121.15, 260, 262.2, 262.3, 265.1, 265.2, 121.27, 114, 147; 24/432, 434; 2/234, 265

[56] References Cited

U.S. PATENT DOCUMENTS

| | | | |
|---|---|---|---|
| 3,605,665 | 9/1971 | Donald | 112/265.2 |
| 3,718,105 | 2/1973 | Glindmeyer | 112/265.2 |
| 4,534,067 | 8/1985 | Richardson | 2/234 |
| 4,628,545 | 12/1986 | Metzler | 112/265.2 X |
| 4,846,087 | 7/1989 | Hinckle | 112/265.2 X |
| 4,854,251 | 8/1989 | Hiramatsu et al. | 112/265.2 X |
| 4,892,049 | 1/1990 | Hiramatsu et al. | 112/265.2 |
| 4,911,091 | 3/1990 | Scholl et al. | 112/104 |
| 4,991,527 | 2/1991 | Scholl et al. | 112/265.2 |
| 5,016,549 | 5/1991 | Sadlack et al. | 112/104 |
| 5,060,588 | 10/1991 | Sadlock et al. | 112/265.2 |
| 5,074,230 | 12/1991 | Morii et al. | 112/121.15 |

FOREIGN PATENT DOCUMENTS

| | | | |
|---|---|---|---|
| 2165281 | 8/1977 | France | 112/104 |
| 1062192 | 3/1989 | Japan | 112/265.2 |
| 1365585 | 9/1974 | United Kingdom | 112/265.2 |

OTHER PUBLICATIONS

PFAFF 200-04 Special Service, Sep. 8, 1984.

*Primary Examiner*—Clifford D. Crowder
*Assistant Examiner*—Ismael Izaguirre
*Attorney, Agent, or Firm*—Laff, Whitesel, Conte & Saret

[57] ABSTRACT

In addition to a sewing machine, a sewing unit has a workpiece holder, which has two workpiece bearing plates displaceable relative to each other, a holding bar, a folding, bar, a thrower device, a cloth slider and a folding device. By these devices, first and second trouser parts having rim strips are faced and overlapped inside-out onto a zipper. The front inseam is sewn, then the rim strip of the second trouser part is folded over and a first zipper seam is sewn. The second trouser part is folded over right-side out and the j-seam is sewn. The rim strips of the first and second trouser parts can be folded before sewing, seam locks can be provided, and a lower covering strip can be provided to the zipper as well. Thus, all three seams can be sewn with a single sewing arrangement.

25 Claims, 18 Drawing Sheets

FIG. 9
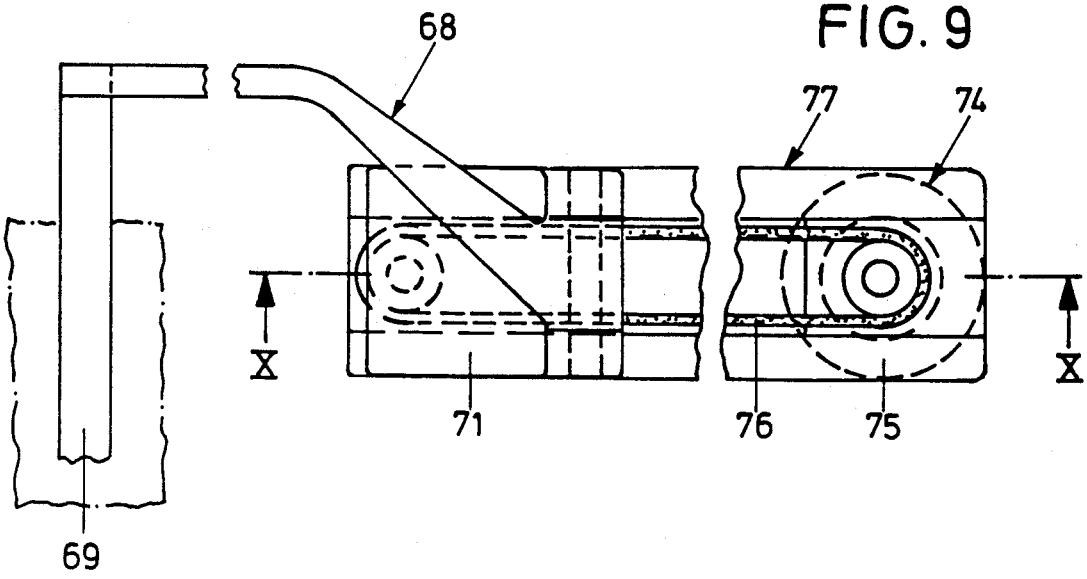
FIG. 10
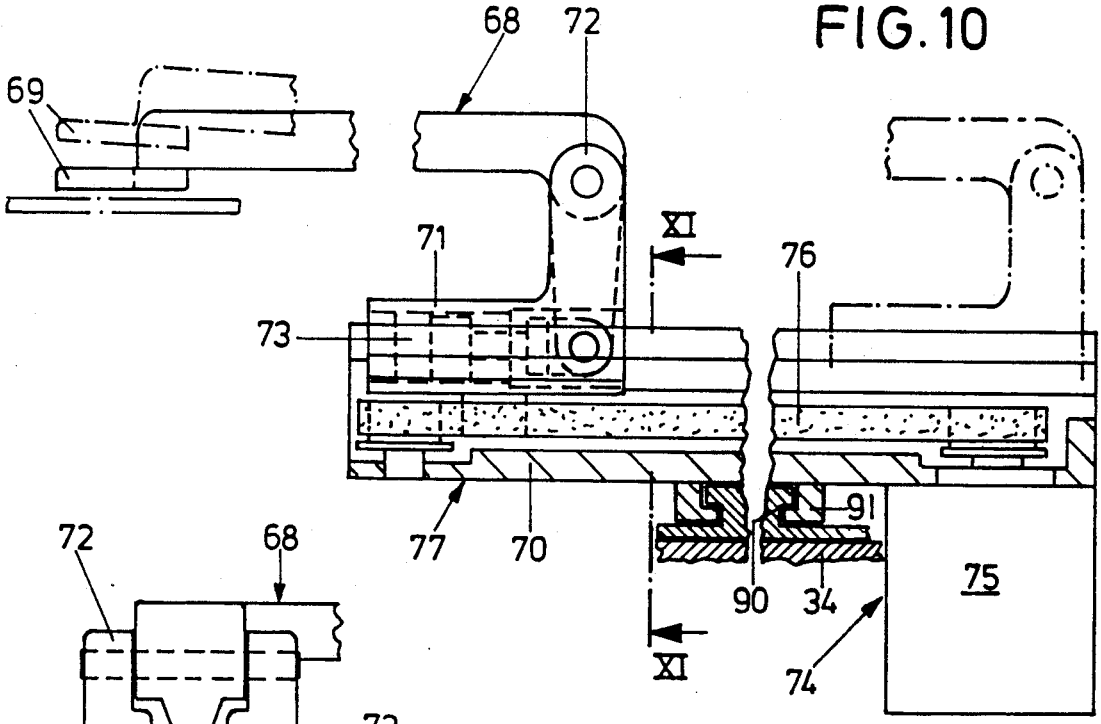
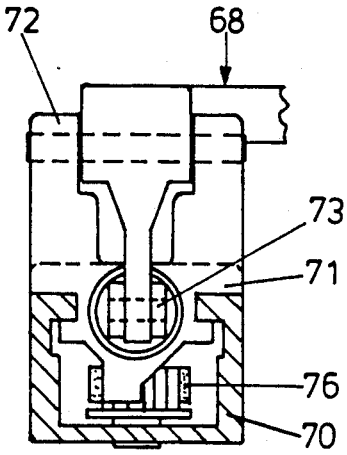
FIG. 11

MANIPULATING AND SEWING TWO TROUSER PORTIONS HAVING RIM STRIPS TO A ZIPPER AND APPARATUS USED THEREIN

BACKGROUND OF THE INVENTION

1. Field of the Invention

The invention relates to a method of joining a first trouser part and a second trouser part by sewing a front trouser inseam and by inserting a zip fastener and a sewing unit for putting this method into practice.

2. Background Art

It is known practice from the publication of Pfaff Industrienähmaschinen GmbH entitled "PFAFF 200-04 Special Service" to sew together the associated strip of cloth on a left trouser forepart, the so-called left fly lining, and the associated area of the trouser forepart. The sewn-on strip of cloth is then folded over and the associated zip-fastener half, i.e. the left zip-fastener component, is sewn on. This strip of cloth is subsequently folded over again and the left joining seam is produced between the strip of cloth and the trouser forepart. Also, the sewing of the right strip of cloth having the right zip-fastener component, i.e. the associated zip-fastener half, on to the right trouser forepart takes place in several work cycles.

It is known from U.S. Pat. No. 4,534,067 to manufacture trouser flies in such a manner that an additional strip of cloth is also cut in one piece with each of the two trouser foreparts in the fly area and is then folded over and sewn together with the trouser forepart. In addition, a zip-fastener half, i.e. a zip-fastener component, is also sewn on. In the case of the left trouser forepart the outer edge is pressed inwards so that a four-layered design is formed in this case which is then stitched.

It is known from U.S. Pat. No. 4,911,091 to attach a strip of cloth provided with a zip fastener component to in each case one of two trouser foreparts such that the edge of the trouser forepart is folded over prior to being sewn together with the strip of cloth, that the trouser forepart with the folded-over edge and the strip of cloth are positioned relative to one another in a position which they occupy after being joined together. Then a zip fastener seam is sewn.

In addition to this it is known from U.S. Pat. No. 5,016,549 to fold over a rim of the strip of cloth and then the rim of the trouser forepart prior to the strip of cloth being joined to the trouser forepart, the strip of cloth being arranged above the trouser forepart and the folded-over rim of the trouser forepart and the folded-over rim of the strip of cloth being positioned in a position relative to each other which they will occupy after being joined together. Subsequently, the folded-over rims are brought into mutual contact. Then they are joined together with a single zip fastener seam.

It is known practice from the industrial sewing technique to sew together a first trouser part turned inside out and a second trouser part turned inside out and a zip fastener in such a way that first the first trouser part is joined to a half of the zip fastener by means of a first zip fastener seam, that subsequently the second trouser part equally turned inside out is joined to the second half of the zip fastener by means of a second zip fastener seam, the so-called J-seam, that then a front inseam is sewn and that subsequently a seam lock is sewn in the transition area from the zip fastener or the trouser fly formed by the latter, respectively, and the front inseam. This manual procedure requires a great number of different manipulations of the two trouser parts and the zip fastener.

SUMMARY OF THE INVENTION

It is an object of the invention to create a method of the generic type, by means of which with as little manipulations as possible of the trouser parts and the zip fastener these can be joined by a first zip fastener seam, a second zip fastener seam and a front inseam. It is a further object of the invention to create a sewing unit for putting this method into practice.

For the solution of this object the method according to the invention proceeds from that prior to sewing, the first trouser part and the second trouser part lie one positioned on top of the other and are joined by means of a front inseam, and that then the first trouser part is sewn together with a half of the zip fastener, the rim strip of the second trouser part being turned away. Subsequently, the second trouser part is lifted off the first trouser part and folded over by 180°, its rim strip overlapping the other half of the zip fastener and then being sewn together with it by means of a second zip fastener seam, the so-called J-seam. The sequence of operations need not forcibly correspond to the sequence given in claim 1.

The method according to the invention can basically be used to sew the rim strips of the first and the second trouser part each simply resting on the two halves of the zip fastener together with the halves, if the rim strips have been finished correspondingly; as a rule it will however be of advantage to fold the rim strips over. Within the scope of the method according to the invention it is further possible that upon folding over of the second trouser part a zip fastener covering strip is formed.

An advantage of the method according to the invention further resides in that while the individual seams are sewn any seam locks can already be sewn as desired. This is particularly simplified by the sequence of production of the individual seams.

The object according to the invention is further solved by a sewing unit for joining a first trouser part and a second trouser part by sewing a front trouser inseam and by inserting a zip fastener.

Further details, advantages and features of the invention will become apparent from the ensuing description of an example of embodiment of the invention together with some modifications, taken in conjunction with the drawing.

BRIEF DESCRIPTION OF THE DRAWINGS

FIG. 9 is a plan view of a displacing unit according to arrow IX in FIG. 8, FIG. 10 is a vertical longitudinal section through the displacing unit along the section line X—X in FIG. 9, FIG. 11 is a vertical cross-section through the displacing unit along the section line XI—XI in FIG. 10.

DESCRIPTION OF THE PREFERRED EMBODIMENT

Figure 1:
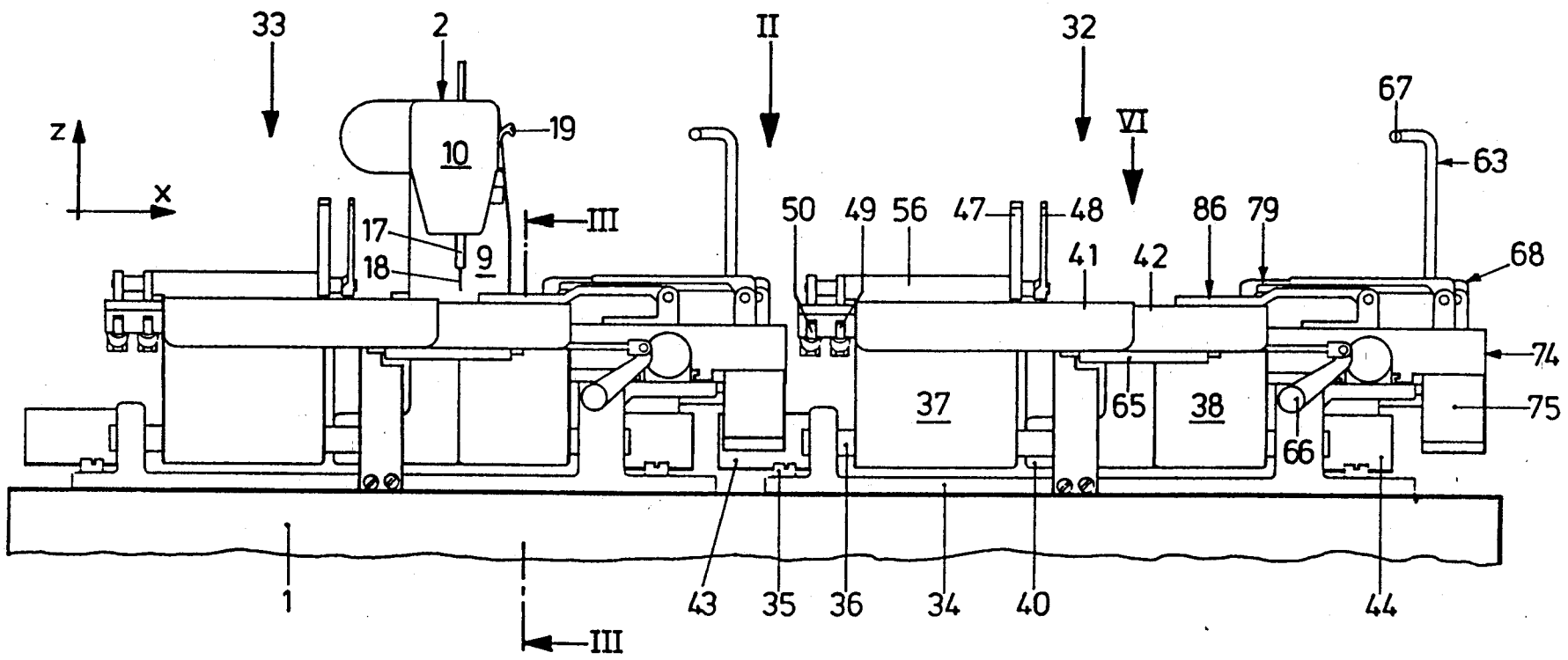
FIG. 1 is a front view of an automatic sewing unit with two workpiece holders.
Figure 2:
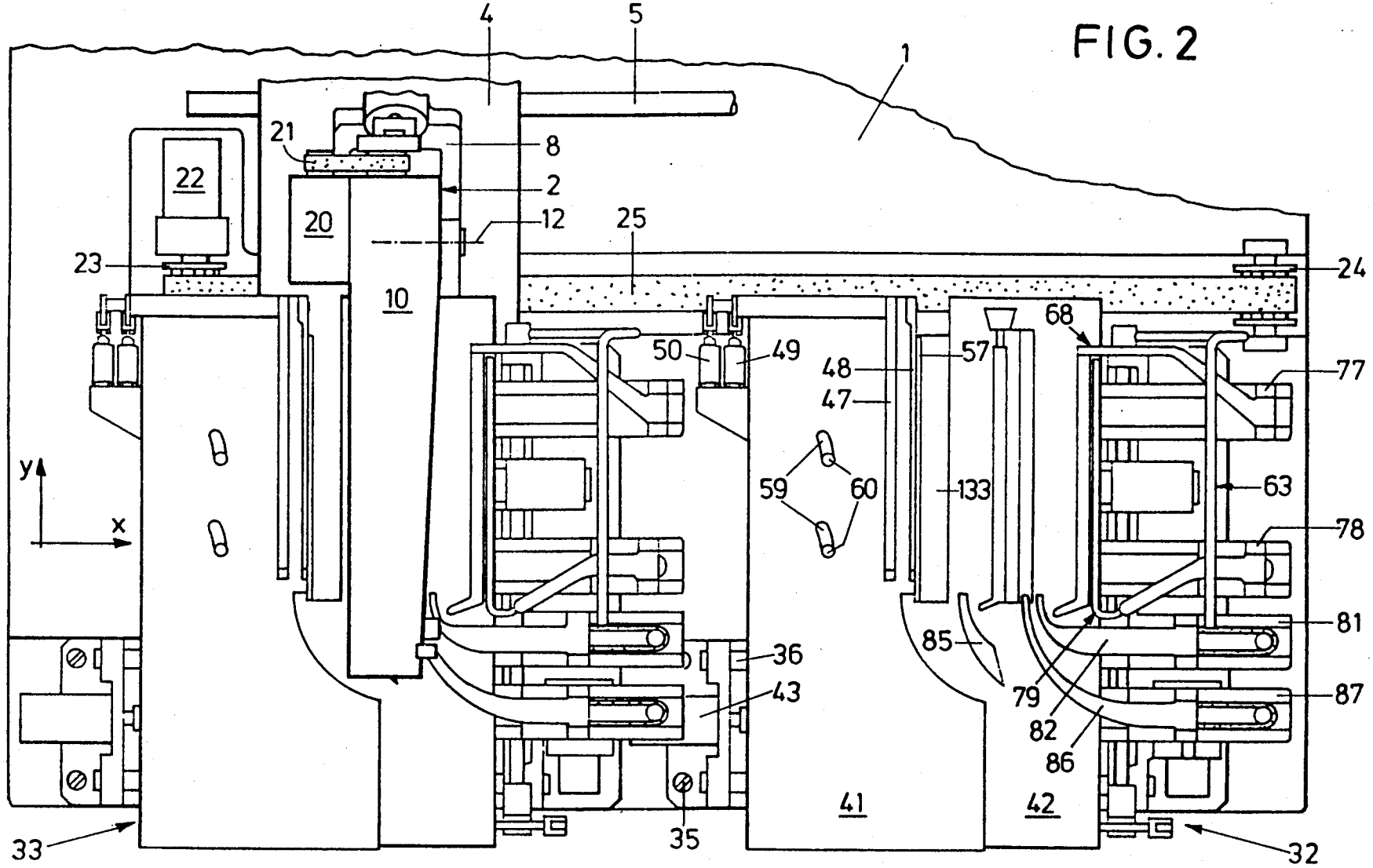
FIG. 2 is a plan view of the automatic sewing unit according to arrow II in FIG. 1.

The automatic sewing unit shown in the drawing has a stand 1, on which a sewing machine 2 is arranged. The sewing machine is arranged on an x-y carriage 3, a so-called cross-carriage, for displacement on a horizontal x-y plane. The x-y carriage 3 has an x carriage 4 displaceably supported on two guide rods 5 parallel to each other and—arranged on a common horizontal plane—extending in x-direction. These guide rods 5 are supported stationarily in the stand 1. Guide rods 6 equally extending on a common horizontal plane and in y direction at right angles to the guide rods 5 are arranged on the x carriage 4, on which guide rods 6 a y carriage 7 is supported for corresponding displacement in y direction. The x carriage 4 and the y carriage 7 with the guide rods 5, 6 form the x-y carriage 3.

Figure 3:
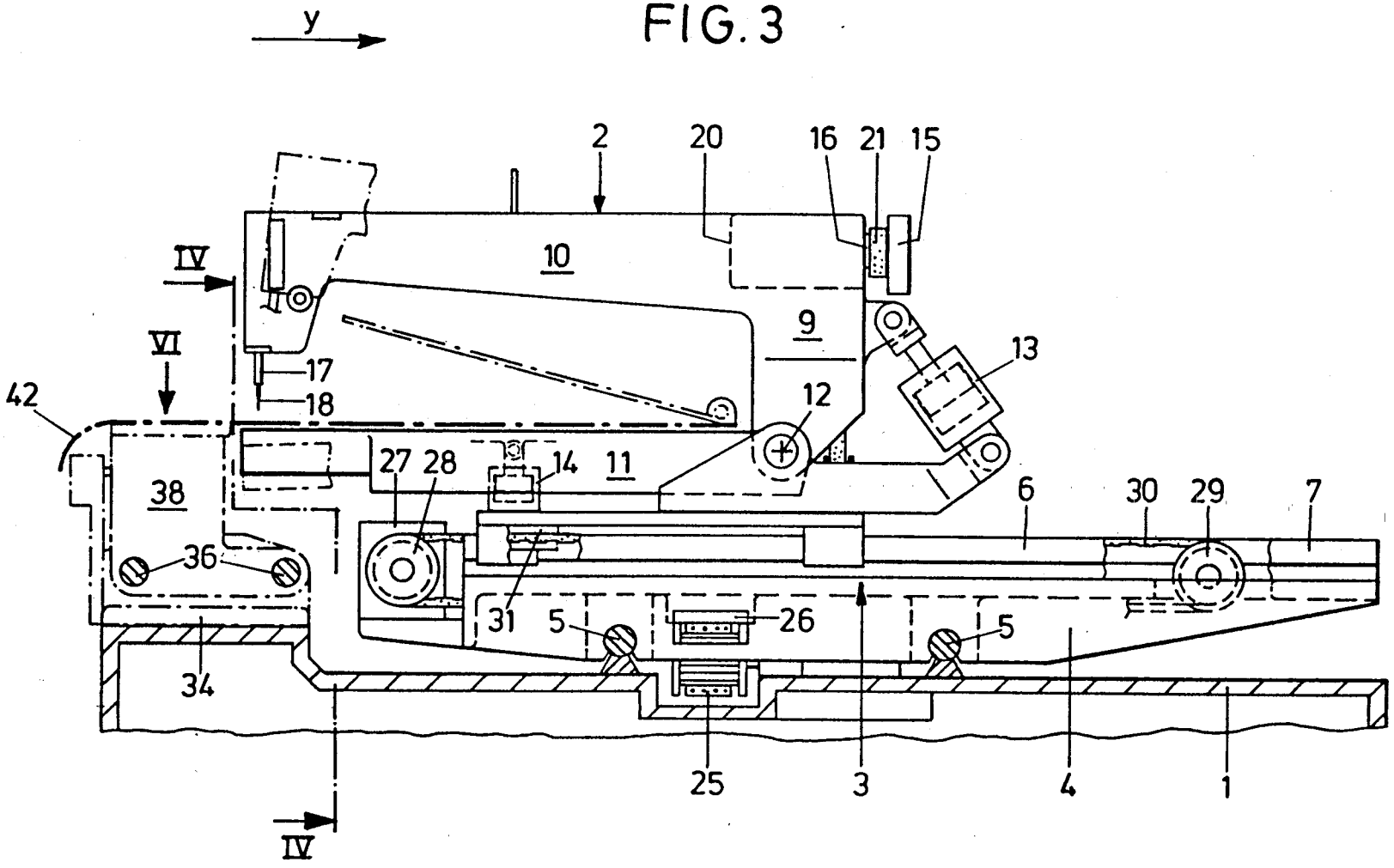
FIG. 3 is a vertical cross-section through the automatic sewing unit along the section line III—III in FIG. 1.
Figure 4:
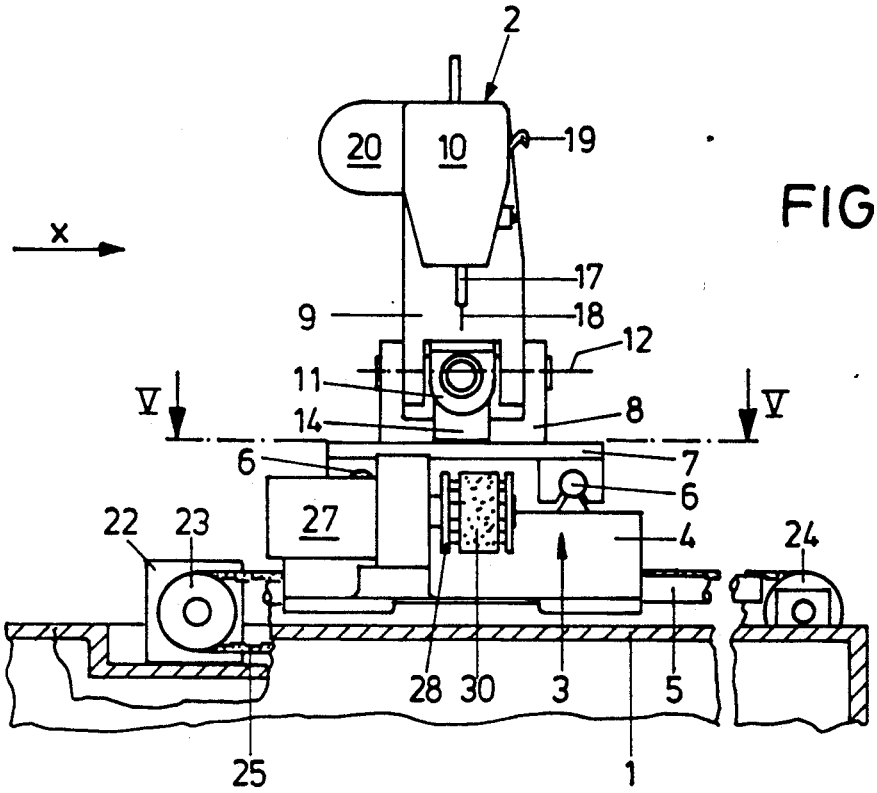
FIG. 4 is a vertical part section along the section line IV—IV in FIG. 3.

A carrier 8 is arranged on the y carriage 7, on which carrier 8 the standard 9 with the upper arm 10, on the one hand, and the base plate 11 also to be designated as lower arm, on the other hand, of the sewing machine 2 are supported to be tilted about a common tilt axis 12. A pneumatically actuatable piston-cylinder drive is articulated on the standard 9 on the one hand and on the carrier 8 on the other hand as an arm tilting drive 13 for the standard 9 with the arm 10, by means of which drive the arm 10 can be tilted from its normal operating position shown in solid lines in FIG. 3 upwards into a position shown in dot-dash lines in FIG. 3. Another pneumatically actuatable piston-cylinder drive is arranged on the carrier 8 on the one hand and on the bottom side of the base plate 11 on the other hand as a base plate tilting drive 14, by means of which the base plate 11 can be moved from its normal operating position shown in solid lines in FIG. 3 to a lowered position shown in dot-dash lines in FIG. 3. At its free outside end the sewing machine 2 usually has an arm shaft 16 provided with a hand wheel 15 and by which a needle bar 17 with a needle 18 and a thread lever 19 are drivable to move up and down. A looper and a thread cutter are in usual manner arranged in the base plate 11. Insofar the sewing machine 2 is in the form of a usual two-thread lock stitch sewing machine. It is driven by a drive motor 20 via a drive belt 21.

A drive motor 22 provided with a timing belt pinion 23 is arranged on the stand 1 to drive the x carriage 4. An endless timing belt 25 secured to the x carriage 4 by means of a clamping device 26 is guided via this pinion 23 and via a deflection pulley 24 supported on the stand 1.

A drive motor 27 equally provided with a timing belt pinion 28 is arranged on the y carriage 7 to drive the latter. An endless timing belt 30 secured to the y carriage 7 by means of a clamping device 31 is guided via the pinion 28 and via a deflection pulley 29 equally supported on the y carriage 7. All the drive motors 20, 22, 27 are controllable; they are for example controllable d.c. motors.

As seen in FIG. 1, two workpiece holders 32, 33 are arranged on the stand 1, which are of identical structure. For this reason only the workpiece holder 32 is specified. Two workpiece holders 32, 33 are provided so that the sewing machine 2 can be used alternately. The workpiece holder 32 has a carrier 34 firmly secured to the stand 1 by means of screws 35. Guide rods 36, which extend parallel to each other in x direction and on which a first carriage 37 and a second carriage 38 each are displaceably guided by means of sliding bearings 39, 40, are arranged on the carrier 34. The first carriage 37 carries a first workpiece bearing plate 41, while the second carriage carries a second workpiece bearing plate 42. The first carriage is displaceable between two end positions by means of a first displacing drive 43 formed as a pneumatically actuatable piston-cylinder drive. The first displacing drive is secured to the carrier 34. The carrier 34 is further provided with a second displacing drive 44, by means of which the second carriage 38 with the second bearing plate 42 can be displaced between two end positions. This displacing drive, too, is structured as a pneumatically actuatable piston-cylinder drive.

Figure 7:
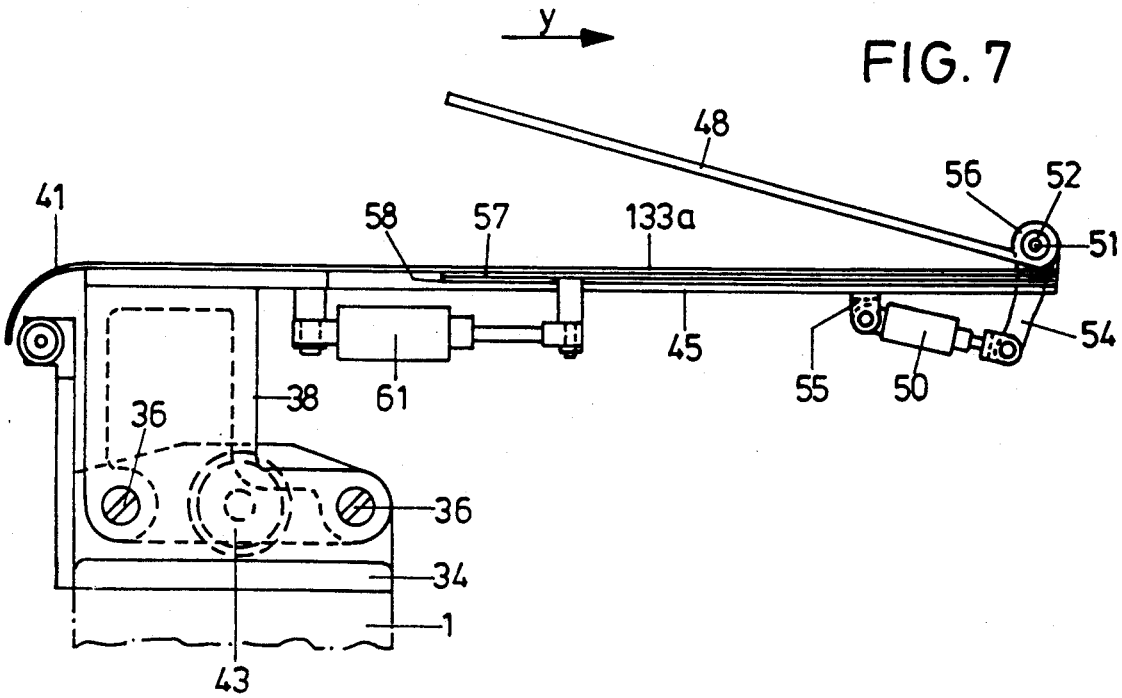
FIG. 7 is a vertical cross-section along the section line VII—VII in FIG. 6.
Figure 5:
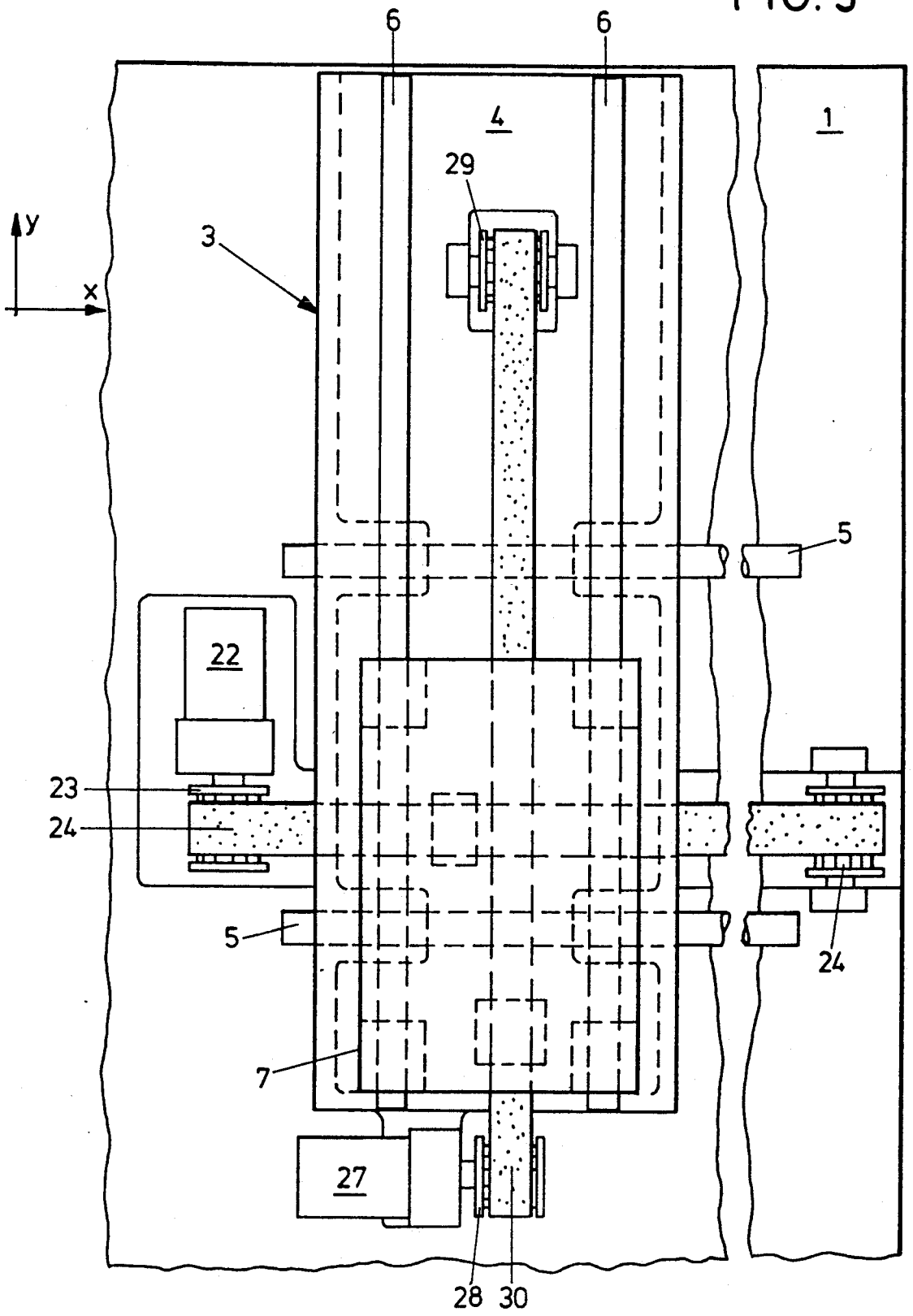
FIG. 5 is a horizontal part section through the automatic sewing unit along the section line V—V in FIG. 4.

On its side facing away from the second workpiece bearing plate 42 the first workpiece bearing plate 41 is reinforced by a supporting bar 45. Apart from that the bearing plate 42 is made from comparatively thin sheet. At its end facing away from the operator's side a holding bar 47 and a folding bar 48 are arranged for tilting. They are tilted between two positions by means of two drives, namely by means of a holding-bar drive 49 and a folding-bar drive 50, respectively. In a lowered position they bear on the first bearing plate 41. In a second position tilted upwards they are located above the first bearing plate 41, as shown in FIG. 7. The drive transmission from the two drives 49 and 50 to the holding bar 47 or the folding bar 48 takes place by way of a shaft 51 for the folding bar 48 and by way of a hollow shaft 52 receiving the shaft 51 for the holding bar 47. The drives 49, 50 structured as pneumatically actuatable piston-cylinder drives each engage with tilting levers 53 or 54, respectively, connected with the shaft 51 or the hollow shaft 52, respectively. On the other hand they bear against an abutment 55 arranged on the supporting bar 45. While the shaft 51 is received in the hollow shaft 52, the hollow shaft 52 is in turn supported on a sleeve-like bearing 56 attached on the first workpiece bearing plate 41 in the vicinity of the latter's rear edge.

On the bottom side of the thin first workpiece bearing plate 41 consisting of sheet a bow slider 57 is guided for displacement and is retained downwards by means of a correspondingly cut-out supporting plate 58, which is in turn retained on the bottom side of the first bearing plate 41. In the first bearing plate 41 itself two guide grooves 59 are provided guiding guide journals 60 arranged on the bow slider 57. Further, a bow drive 61 is in engagement with the bow slider 57 and is formed as a pneumatically actuatable piston-cylinder drive bearing in turn on the supporting bar of the first bearing plate 41. By means of the bow drive 61 the bow slider 57 can be displaced corresponding to the path of the two guide grooves 59 substantially in y direction, such a displacement being superposed by a movement in x direction resulting from the curvature of the guide grooves 59. Thus the bow slider 57 can be displaced between two positions. In a first position—shown in FIG. 6—the bow edge 62 of the bow slider 57 is in a position shifted beyond the folding bar 48, whereas in a retracted position—to be explained below—of the bow slider 57 it is flush with the folding bar 48.

Figure 6:
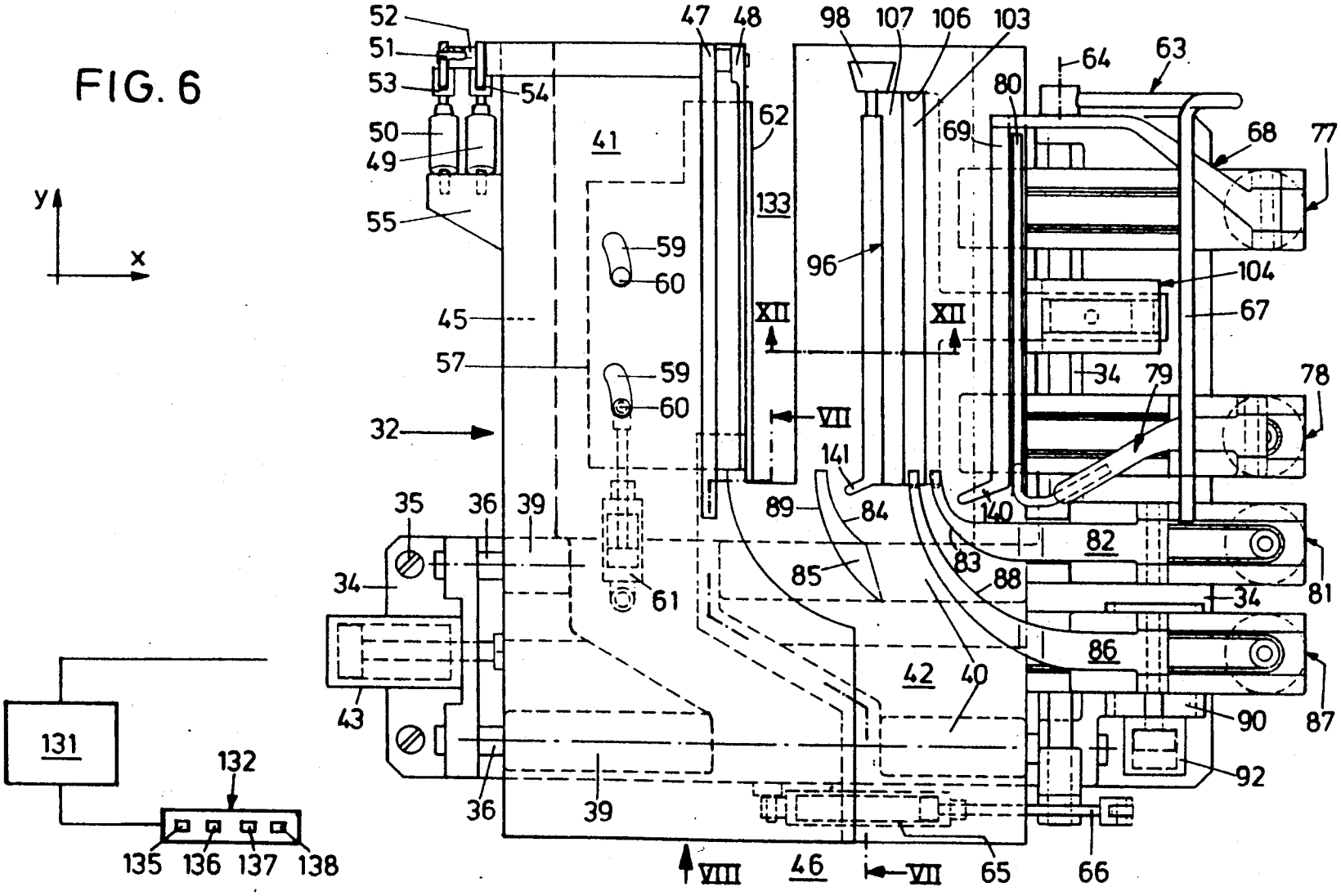
FIG. 6 is an enlarged part plan view of a workpiece holder according to arrow IV in FIG. 1.
Figure 8:
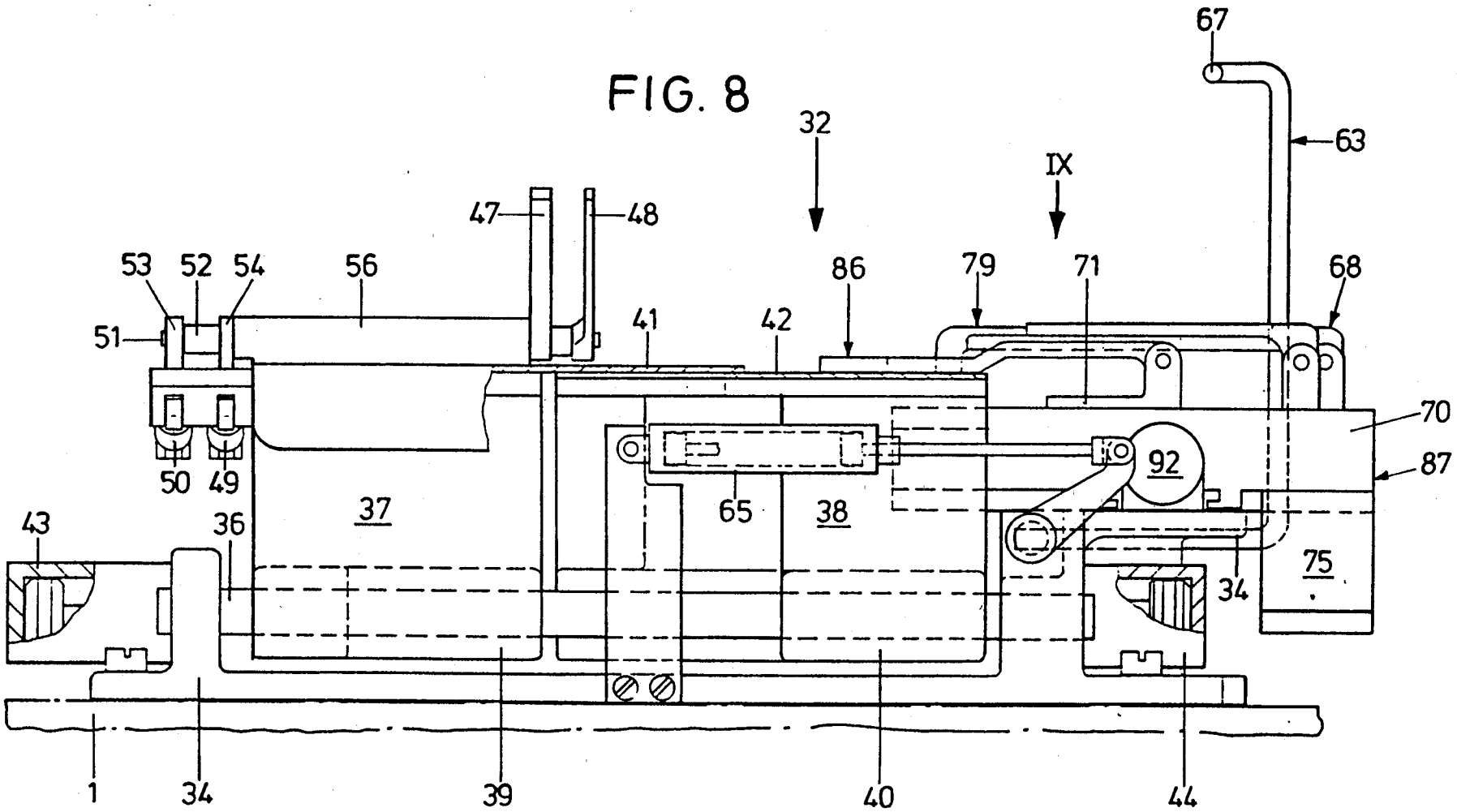
FIG. 8 is a front view of a workpiece holder according to arrow VIII in FIG. 6 on an enlarged scale referred to FIG. 1 and in an illustration partially broken open.

As seen in the plan view—the carrier 34 of the workpiece holder 32 is about angular in shape, i.e. seen from the operator's side 46 it extends along the front of the workpiece holder 32 in x direction and along the right outer face in y direction. Further, a thrower device 63 is supported on the carrier 34 to be tilted about a tilt axis 64 extending in y direction. A tilting drive 65 for the thrower device is articulated on the carrier 34 on the one hand and on a crank 66 of the thrower device 63 on the other hand. The tilting drive 65 is in the form of a pneumatically actuatable piston-cylinder drive. It has a thrower rod 67 extending in y direction, which can be tilted into a thrower position, on the one hand—as shown in FIG. 6—and, on the other hand, into a position lowered on to the first workpiece bearing plate 41, as described below referring to FIG. 24.

A cloth slider 68 is further provided to be essentially angular in shape—as seen in the plan view—and having a cloth slider rod 69 extending in parallel to the thrower rod 67 and in parallel to the holding bar 47 and to the folding bar 48 when the latter are in their position lowered on to the first bearing plate 41, i.e. in y direction. Consequently, it also extends parallel to the first and second bearing plate 41 or 52, respectively. It is displaceable parallel to itself, as substantially seen in FIGS. 9 to 11. To this effect the carrier 34 is provided with a guide rail 70, on which a guide carriage 71 is guided for displacement in x direction. The guide carriage 71 is provided with a tilt bearing 72, on which the cloth slider 68 formed as an angle lever is supported to be tilted about an axis extending in y direction. A cloth slider tilt drive 73 is arranged on the guide carriage 71 and engages in turn with the cloth slider 68, so that the cloth slider rod 69 can be moved about perpendicularly referred to the x-y plane, i.e. about in z direction. Further, a sliding drive 74 engages with the guide carriage 71 and produces the mentioned displacements of the guide carriage 71 with the cloth slider 68 in x direction. In the exemplary embodiment illustrated the sliding drive 74 consists of a stepping motor 75 with a belt drive 76 engaging with the guide carriage 71. In like manner the sliding drive 74 can of course also be formed by a pneumatically actuatable piston-cylinder drive. The guide rail 70 with the guide carriage 71, the tilt bearing 72, the tilt drive 73 and the sliding drive 74 forms a displacing unit 77 for the cloth slider 68. FIG. 10 illustrates different positions between which the cloth-slider rod 69 can be moved. On the one hand this is a position shown in solid lines, in which the cloth slider rod 69 rests on the first bearing plate 41. Further, this is a position shown in dot-dash lines on the left in FIG. 10, in which the cloth slider rod 69 is lifted off the first bearing plate 41 upwards in z direction. Further, this is the position shown in dot-dash lines on the right in FIG. 10, in which the cloth slider 68 and thus also the cloth slider rod 69 are in a retracted position also shown in FIG. 6. In x direction there is another intermediate position, which will still be referred to in the functional specification.

Furtheron, the carrier 34 is provided with a displacing unit 78 for a folding device 79 having a folding rod 80 equally extending in y direction. The displacing unit 78 for the folding device 79 is of similar structure as the displacing unit 77, so that reference is made to that part of the specification relating to FIGS. 9 to 11. By means of the displacing unit 78 the folding rod 80 is displaceable in x direction into a retracted position shown in FIG. 6 and into an extracted position on the first bearing plate 41 and into an intermediate position, while simultaneously being removable from the first bearing plate 41 in z direction.

Further, an inner trouser inseam bar 82 is arranged on the carrier 34 by means of a displacing unit 81, which is also identical with the displacing units 77, 78, so that a renewed description is not necessary. The inner trouser inseam bar 82 extends substantially in the x-y plane and is of curved shape, its outside edge 83 extending in accordance with the inside edge 84 of an opening 85 in the second workpiece bearing plate 42. By means of the displacing unit 81 the inner trouser inseam bar 82 can be moved from a retracted position—shown in FIG. 6—into an extracted position, in which its outside edge 83 substantially coincides with the inside edge 84 of the opening 85, the movement of displacement in x direction taking place in a position lifted off the second bearing plate 42 in z direction.

Further, an outer trouser inseam bar 86 is arranged on the carrier 34 by means of a displacing unit 87 again identical with the displacing units 77, 78, 81. It also substantially extends in the x-y plane and is of curved shape, its inside edge 88 corresponding to the course of the outside edge 89 of the opening 85. It can be moved from the retracted position shown in FIG. 6 in x direction into an intermediate position and into a position in which its inside edge 88 substantially coincides with the outside edge 89 of the opening 85. In this case, too, the movements of displacement in x direction take place in a position of the outer trouser inseam bar 86 lifted off the second bearing plate 42 in z direction.

Reaching beyond the three displacing units 77, 78, 81 the displacing unit 87 for the outer trouser inseam bar 86 is also displaceable in y direction. To this effect the carrier 34 is additionally provided with a rail 90 engaging with a sliding guide 91 outlined in dot-dash lines in FIG. 10. For displacement the carrier 34 is provided with a displacing drive 92 formed as a pneumatically actuatable piston-cylinder drive engaging with the displacing unit 87. By means of this displacing drive 92 the outer trouser inseam bar can be displaced from the position shown in FIG. 6 in y direction towards the operator's side 46.

The second workpiece bearing plate 42 is made in sandwich construction, i.e. it has an upper plate 93, a lower plate 94 and a spacing plate 95 spacing the two apart. The spacing plate 95 is tightly connected with the upper plate 93 and the lower plate 94 for instance by adhesion. The spacing plate 95 has cut-outs which will still be referred to. A zip fastener nest 96 in the form of a longitudinal opening and extending in y direction is provided in the second bearing plate 42, into which a zip fastener 97 can be introduced in y direction through a zip fastener inlet 98. On both sides of the nest 96 retainers 99, 100 for the halves 101*a*, 101*b* of the zip fastener 97 are provided, as can be seen in particular from FIG. 12, to which effect the spacing plate 95 is undercut in the vicinity of the retainer 99. It results from the foregoing that—in the embodiment according to FIG. 12—the spacing plate 95 has about the thickness of the halves 101*a*, 101*b* of a zip fastener 97 so that the latter is retained in its position introduced in the nest 96.

Between the upper plate 93 and the lower plate 94 a seam width slider 103 having the form of a T-shaped bar is formed in a corresponding cut-out 102 of the spacing plate 95, the web of the seam width slider 103 being connected with a sliding drive 104 supported relative to the second workpiece bearing plate 42. For this purpose the sliding bearing 104 is attached to a bearing bar 105 serving to reinforce the second bearing plate 42. It is formed as a pneumatically actuatable piston-cylinder drive as can be taken from FIG. 12. The leg of the T forms the retainer 100 of the zip fastener nest 96. The leg of the T is displaceable in x direction in a corresponding approximately rectangular recess 106 of the second workpiece bearing plate 42, namely between the position shown to be extracted in FIG. 12, in which it defines the zip fastener nest 96, and a retracted position, in which it releases the half 101*b* of the zip fastener 97 located in the retainer 100. The leg of the T is to this effect provided with an abutment bar 107 located on the plane of the upper plate 93 and the lower plate 94. In the retracted position the seam width slider 103 closes the recess 106, so that—as will be specified below—a seam can be sewn at a greater or larger distance.

Figure 12:
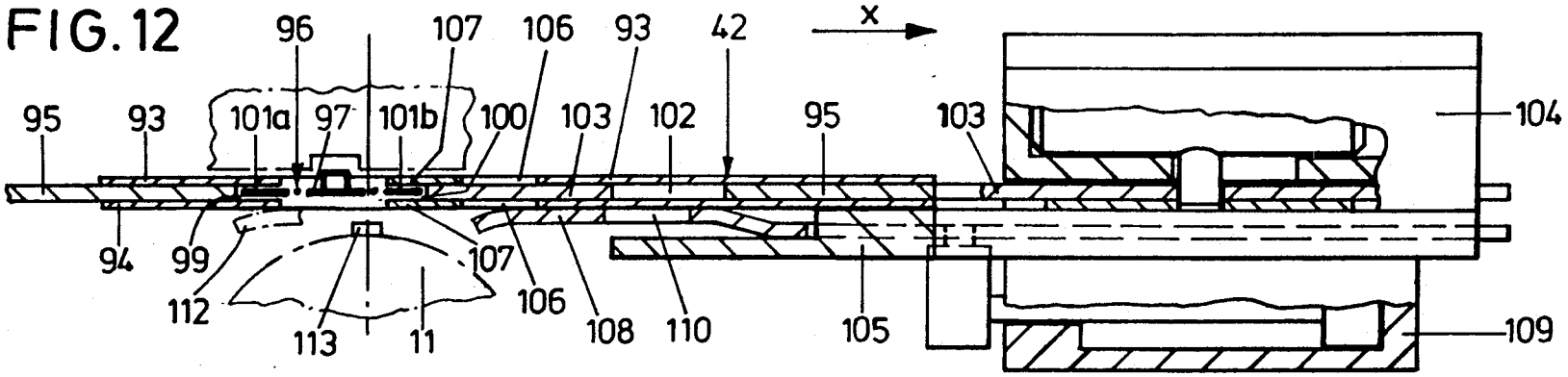
FIG. 12 is a vertical longitudinal section through the workpiece holder along the section line XII—XII in FIG. 6.
Figure 13:
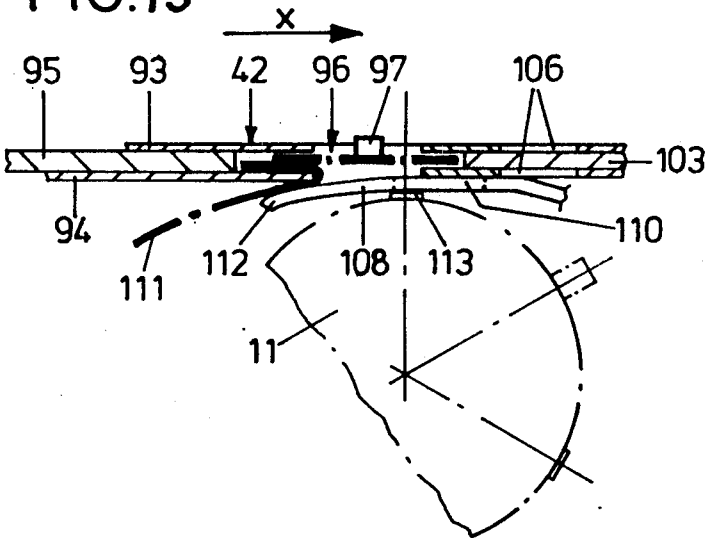
FIG. 13 is a partial representation from FIG. 12 with a zip fastener with a lower covering strip being illustrated instead of a simple zip fastener.

Furtheron, a supporting slider 108 also displaceable in x direction by means of a supporting slider drive 109 is arranged below the lower plate 94 and bearing against it. This drive 109 is equally stationary relative to the second bearing plate 42, to which effect it is attached to the bearing bar 105. The supporting slider 108 has a longitudinal slit 110. The supporting slider 108 is movable from the retracted position shown in solid lines in FIG. 12 in x direction into an extracted position, in which it covers the zip fastener nest 96 from below, so that a zip fastener 97 is supported from downwards when introduced into the nest 96. Moreover this supporting slider 108 simultaneously serves as a fly placket folding device when a zip fastener 97 is inserted to which has been sewn a so-called fly placket 111, i.e. an inner covering strip, which is a strip of cloth. By means of the downwards directed free end 112 of the supporting slider 108—as can be taken from FIG. 13—the fly placket 111 is in this case folded over towards the bottom side of the lower plate 94 where it is held in place. In the retracted status—as shown in solid lines in FIG. 12—the supporting slider 108 is in any case located outside the sewing field, i.e. not below the zip fastener nest 96. In the position of the supporting slider 108 shown in dot-dash lines in FIG. 12 and shown in solid lines in FIG. 13 the longitudinal slit 110 is situated under the zip fastener nest 96; the longitudinal slit 96 thus enables the needle 18 to pass through unimpeded in a section of the zip fastener nest 96. When the seam width slider 103 is moved into its retracted position, then the longitudinal slit 110 is completely released so that the above-mentioned section is enlarged within which can be sewn. FIGS. 12 and 13 also illustrate a stitch hole 113 of the base plate 11 being associated with the zip fastener nest 96 and with the longitudinal slit 110.

Figure 15:
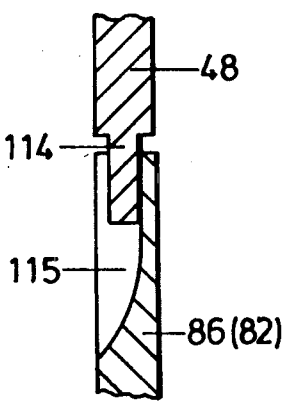
FIG. 15 is a sectional view along the section line XV—XV in FIG. 14.
Figure 14:
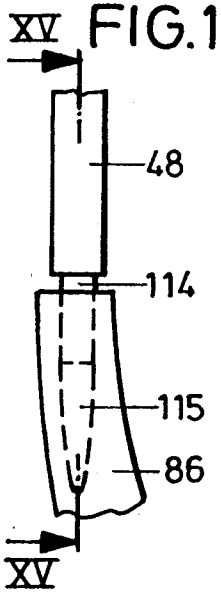
FIG. 14 is an enlarged detail representation of the end of a folding bar and of part of a trouser inseam bar.

It can be seen from FIGS. 14 and 15 that a journal 114 and a matching partial recess 115 are formed at the two ends associated with each other of the folding bar 48, on the one hand, and of the outer trouser inseam bar 86, on the other hand, and that they may be in engagement so that a more rigid connection can be produced between the folding bar 48 and the outer trouser inseam bar 86. A similar partial recess 115 is formed at the end of the inner trouser inseam bar 82, as indicated in FIG. 6.

Prior to the function of the so far specified apparatus being explained, the basic sewing problem is described in conjunction with FIGS. 16 to 20 of the drawing.

Figure 16:
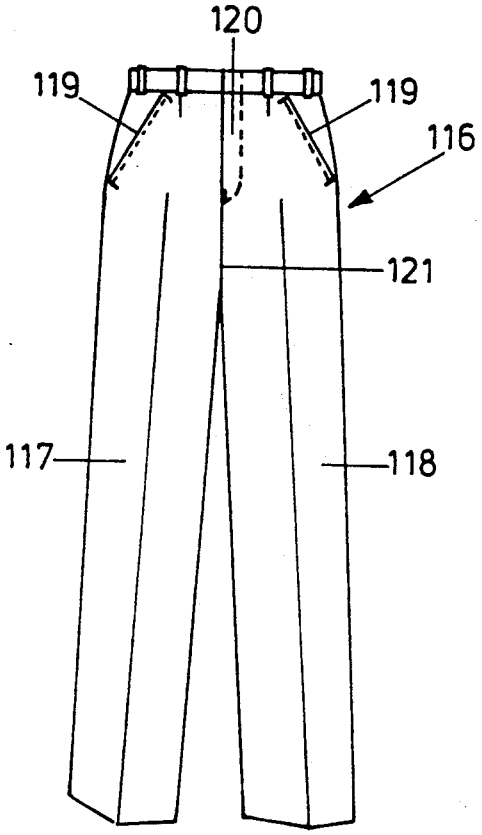
FIG. 16 is a front view of a pair of trousers.

FIG. 16 is a front view of a pair of trousers 116 comprising a right trouser part 117 and a left trouser part 118 in each case inclusive of the trouser legs. As usual, the association of the "right" trouser part 117 and of the "left" trouser part 118 is made as seen by the person wearing the trousers 116. The finished pair of trousers 116 is provided with trouser pockets 119. Moreover, the trouser fly 120 to be produced with the specified apparatus and a front trouser inseam 121 can be seen. The pair of trousers 116 is in its position of use with the proper side turned out.

Figure 17:
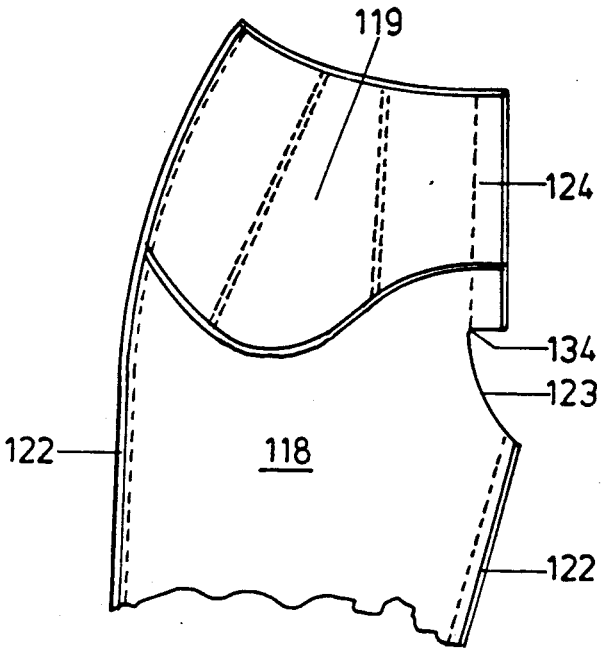
FIG. 17 shows a left trouser part turned inside out on an enlarged scale referred to FIG. 16.

In FIG. 17 the upper section of the left trouser part 118 is shown. The trouser pocket has already been sewn in. All the rims have been finished with overcasting seams 122. A cut-out 123 can be seen in the vicinity of which the front trouser inseam 121 is sewn. Further, a rim strip 124 can be seen which is needed for sewing the trouser fly 120 with the zip fastener 97 being sewn on simultaneously.

Figure 18:
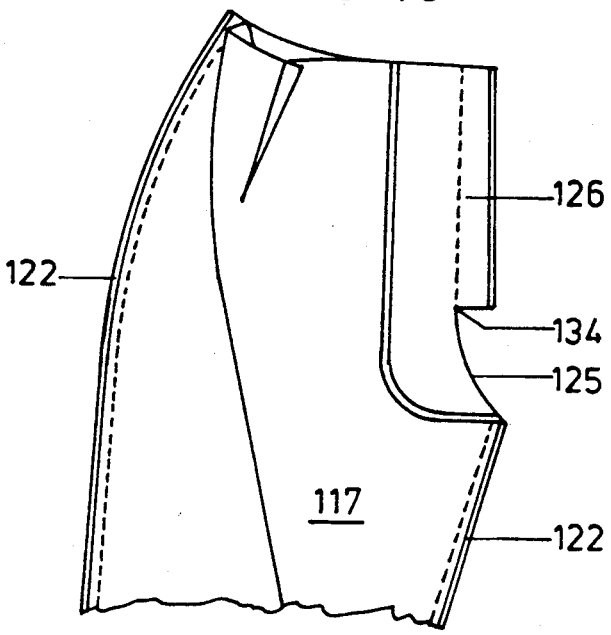
FIG. 18 shows a right trouser part turned inside out on an enlarged scale referred to FIG. 16.

In FIG. 18 the right trouser part 117 is shown turned inside out, the trouser pocket 119 cannot be seen it being arranged on the side facing away from side of view. In like manner a cut-out 125 can be seen, in the vicinity of which the front trouser inseam 121 is produced. Furthermore, a rim strip 126 is shown, which is needed to produce the trouser fly 120 and to sew in the zip fastener 97.

Figure 19:
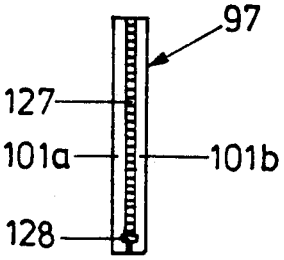
FIG. 19 shows a zip fastener.

In FIG. 19 the zip fastener 97 as used when sewn in is illustrated, i.e. it has the two halves 101 of cloth each provided with a row of teeth 127 in engagement, the locking piece 128 already being applied so that the two halves 101 are connected with each other. The zip fastener slider, the so-called zip, has not yet been applied, which facilitates manipulation.

Figure 20:
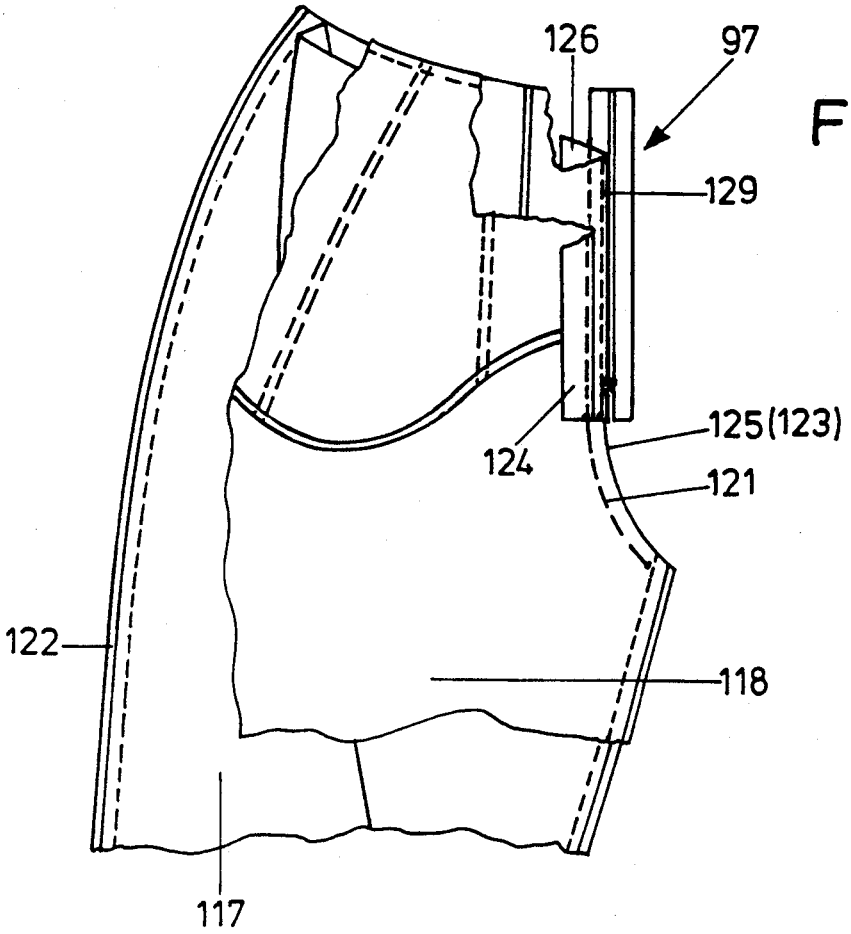
FIG. 20 shows the two trouser parts according to FIGS. 17 and 18 one placed on top of the other, which have been sewn together with a front trouser inseam and a first zip fastener seam.

FIG. 20 shows the right trouser part 117 turned inside out and the left trouser part 118 equally turned inside out and put on top, both in the position as shown in FIGS. 17 and 18. The front trouser inseam 121 has already been produced in the vicinity of the cut-outs 122, 125. Furthermore, the rim strip 126—folded over downwards—has already been sewn together with a half 101 of the zip fastener 97, and that by means of a first straight zip fastener seam 129.

Figure 21:
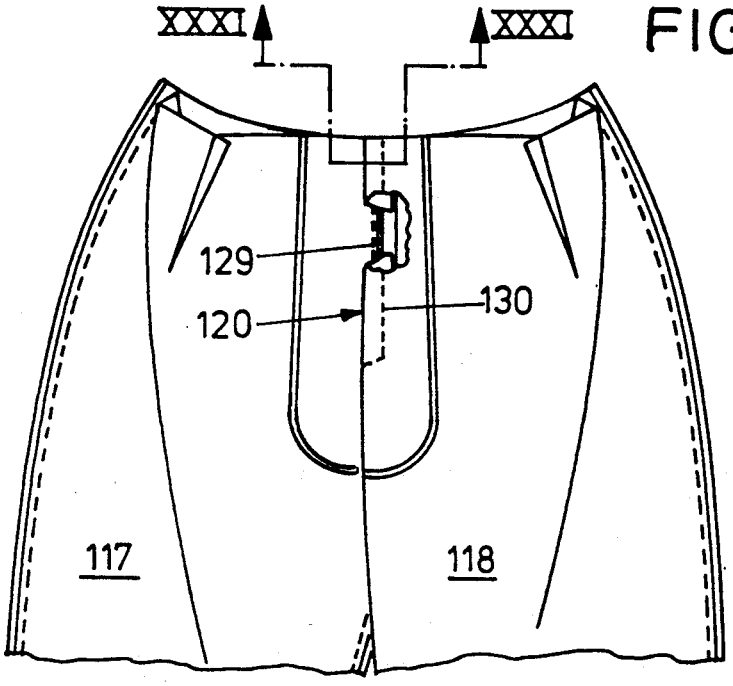
FIG. 21 shows the two trouser parts turned inside out, which have been sewn together by means of a front trouser inseam and a first and a second zip fastener seam in a view through the not yet closed trouser seat seam.

Finally, FIG. 21 illustrates the left trouser part 118 and the right trouser part 117 after the trouser fly 120 has been finished, i.e. after the second zip fastener seam, the so-called J-seam, has been produced.

In the following the function of the above-described workpiece holder is specified taken in conjunction with FIGS. 22 to 29, which show a partial plan view of the workpiece holder 32 corresponding to the representation in FIG. 6, the individual operational cycles being illustrated in sequence. The following description of the displacements of the individual components no longer deals with the problem of via which drive this is effected, since this has been explained in detail above. All the drives of the sewing machine 2 and of the x-y carriage 3 and of the workpiece holder 32 are triggered by a central freely programmable electronic data processing unit 131. If any displacements are to be triggered by the operator, key switches are provided in a keyboard 132, which are dealt with in the following. Of course these key switches or the whole keyboard 132, respectively, are arranged as hand switches or knee switches on the stand 1 or the workpiece holder 32.

Figure 22:
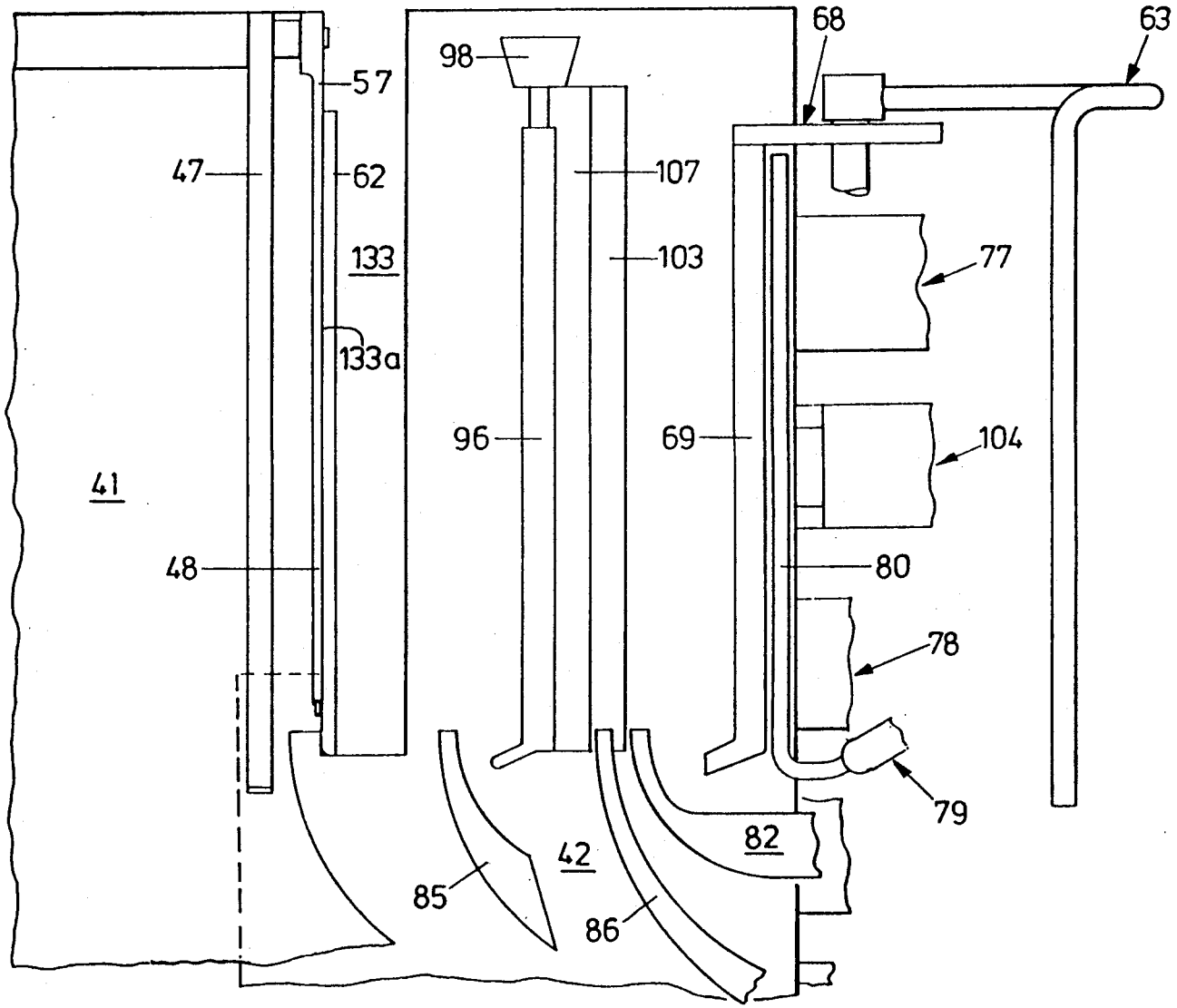
FIG. 22 is a partial representation from FIG. 6 on an enlarged scale with the folding instruments in their starting position.

In the starting position of the workpiece holder 32 according to FIG. 22 the holding bar 47 and the folding bar 48 are tilted upwards, as also shown in FIG. 7. The first bearing plate 41 and the second bearing plate 42 are moved into their retracted positions, so that an opening 133 of rectangular shape in plan view is released between them over about the length of the folding bar 48, which opening 133 is defined on the side of the first bearing plate 41 by the latter's edge 133*a*. The seam width slider 103 is in its extracted position defining the zip fastener nest 96 with the retainer 100. The thrower device 63 is in its retracted position tilted upwards; the lowered folding device 79 and the lifted cloth slider 68 are in their retracted positions. The same applies to the inner trouser inseam bar 82 and the outer trouser inseam bar 86. The bow slider 57 is in its extracted position, in which the bow edge 62 projects beyond the folding bar 48 into the opening 133.

Figure 23:
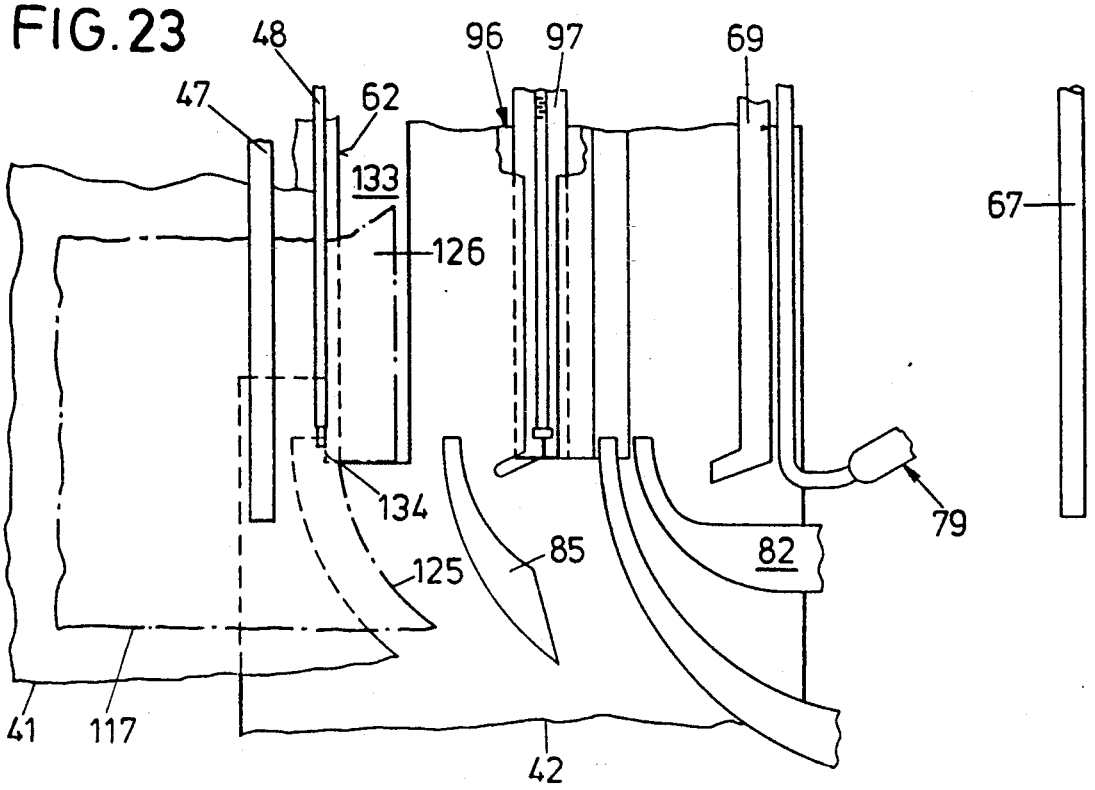
FIG. 23 shows the workpiece holder according to FIG. 22 with a zip fastener inserted and a right trouser part put on, FIG. 24 shows an operating stage with a rim strip of the right trouser part being folded over downwards.

Subsequently—as seen in FIG. 23—the zip fastener 97 is introduced into the zip fastener nest 96 either manually or by means of a known mechanical device. It is introduced over its entire length, i.e. it is positioned. Immediately afterwards the supporting slider 108 is moved from the retracted position shown in FIG. 12 into its extracted position below the zip fastener nest 96, where it supports the zip fastener 97 against sagging. This is triggered by the electronic data processing unit 131.

Then the operator places a right first trouser part 117 turned inside out on the first workpiece bearing plate 41 in the position shown in FIG. 18, the gusset 134 of the cut-out 125 being situated in the corner between the bow edge 62 and the opening 133. The rim strip 126 of the trouser part 117 then hangs over or into the opening 133. By actuation of a key switch 135 in the key board 132 the holding bar 47 and the folding bar 48 are lowered in the direction on to the first workpiece bearing plate 41, i.e. on to the right trouser part 117. Upon this the opening 133 is closed and the rim strip 126 of the right trouser part 117 is folded over about the bow edge 62 and tucked under the bow slider 57 by the second bearing plate 42. Now the first workpiece bearing plate 41 is moved into its right end position (FIG. 24) and the thrower device 63 is lowered by tilting into its position on the first bearing plate 41. Seen from the operator's side it thus takes the position farthest to the left. In the same sequence actuation the cloth slider 68 with the cloth slider rod 69 according to FIG. 20 is moved into its completely extracted, lowered position, i.e. to the extreme left. Further the folding device 79 is moved into an intermediate position and lowered, so that still on the second workpiece bearing plate 42 the folding rod 80 comes to bear between the zip fastener nest 96 and the folding bar 48.

Figure 24:
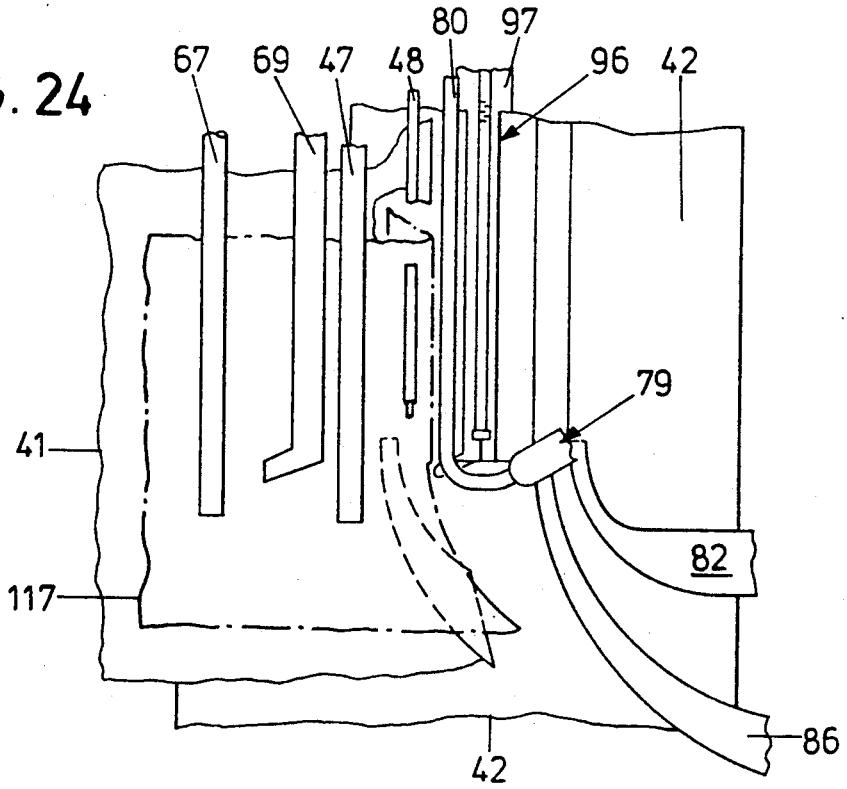

Subsequently the folding bar 48 is again lifted. It had only been lowered so as not to interfere with the movements of the thrower device 63 and the cloth slider 68. These positions are shown in FIG. 24.

Figure 25:
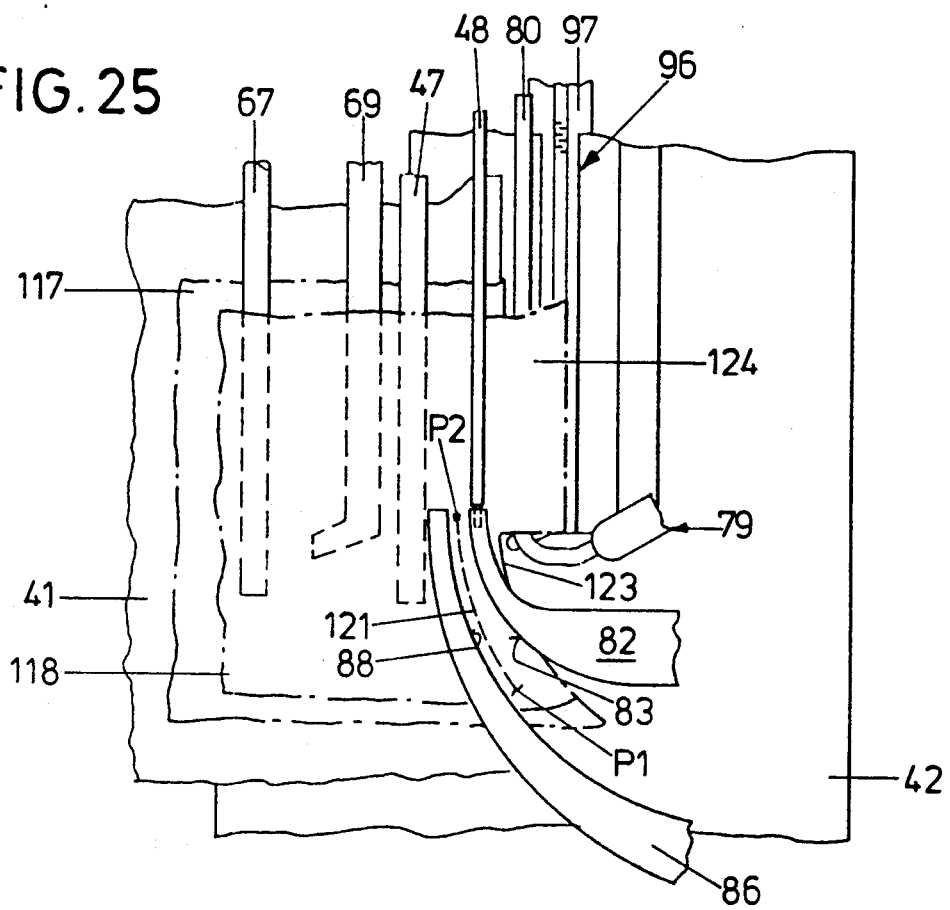
FIG. 25 shows a subsequent stage with a left trouser part being placed on and a front trouser inseam being produced.

Subsequently the operator places a left second trouser part 118 equally turned inside out and positioned as shown in FIG. 17 underneath the lifted folding bar 48 on to the right trouser part 117 already fixed. In relation to the trouser part 117 it is aligned such that the cut-out 123 coincides with the cut-out 125. The rim strip 124 rests on the folding rod 80 of the folding device 79. This is illustrated in FIG. 25. By actuation of a key switch 136 the folding bar 48 is lowered and then bears on the trouser part 118.

Figure 26:
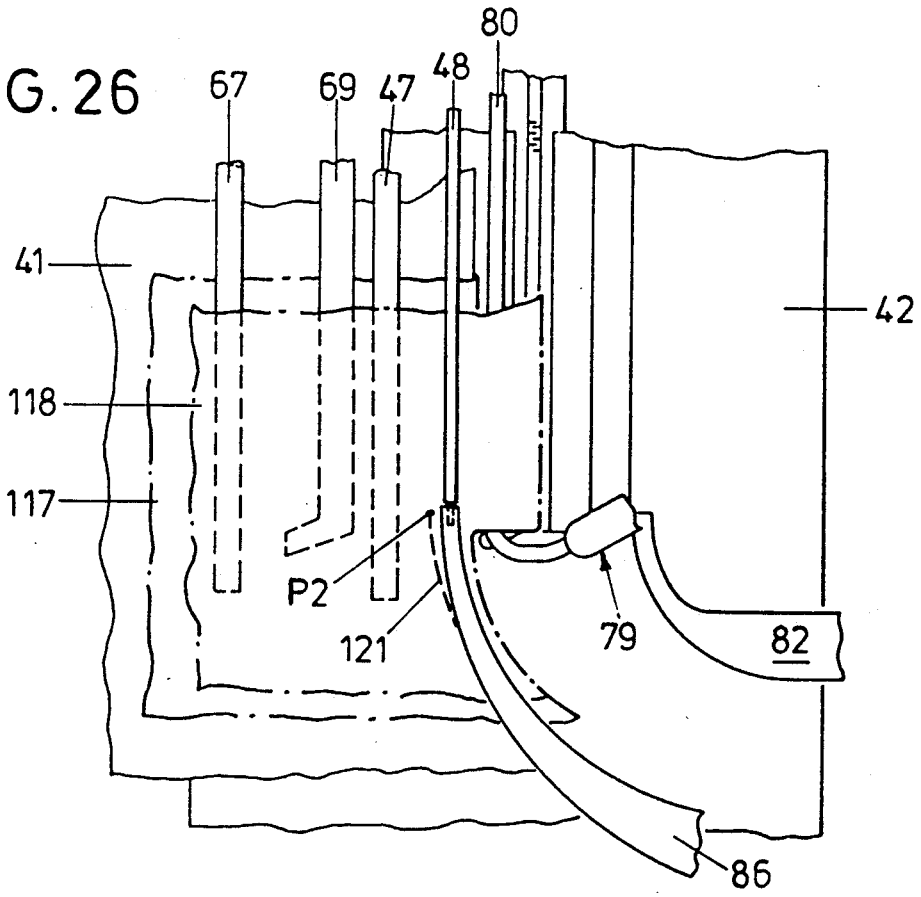
FIG. 26 shows the workpiece holder in a further operating stage with two trouser inseam bars having changed their position.
Figure 27:
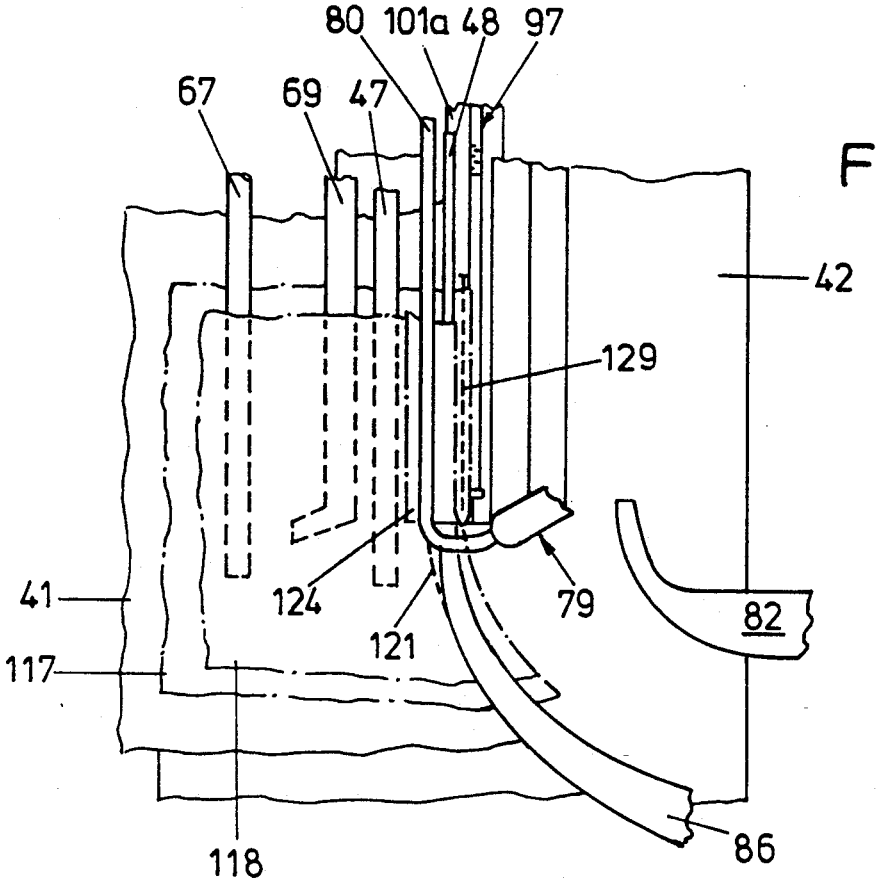
FIG. 27 shows a subsequent operating stage, in which a first zip fastener seam has been produced.

The inner trouser inseam bar 82 and the outer trouser inseam bar 86 are then moved by way of sequence control into their extracted position on the extreme left, where they remain lifted off. The operator then orients the trouser part 118 such that the cut-out 123 is congruent with the cut-out 125 in the described manner. By actuation of a further key switch 137 the trouser inseam bars 82, 86 are then lowered, the inner trouser inseam bar 82 being coupled with the folding bar 48 due to the engagement of the journal 114 and the partial recess 115. The inside edge 88 of the outer trouser inseam bar 86 and the outside edge 83 of the inner trouser inseam bar 82 define between them a field that is approximately congruent with the opening 85. This field and this opening 85 are dimensioned such that a front trouser inseam 121 can be sewn for any possible size of a pair of trousers 116. To this effect an initiating pulse for the sewing process is given by a further key switch 138. The sewing machine 2 is thereby moved with its x-y carriage from a starting position Po (see FIG. 30), in which the sewing machine 2 is situated outside of the area covered by thrower device 63, to a seam starting point P1 of the front inseam 121. During this displacement movement the base plate 11 is lowered and the arm 10 is lifted. In position P1—always by way of sequence control—the arm is lowered and the base plate 11 is lifted and the front inseam 121 is sewn from its starting point P1 to its seam end point P2, as can be taken from FIG. 25 and FIG. 30. At the end of this seam a thread cut-off operation takes place and the arm 10 is lifted. Then the inner trouser inseam bar 82 is lifted and moved into its retracted position to the right. The outer trouser inseam bar 86 is lifted and moved into its intermediate position and lowered, so that it is coupled with the folding bar 48. It now covers partially the front trouser inseam 121 sewn. These positions are shown in FIG. 26. Still within the scope of sequence control the second workpiece bearing plate 42 is moved into the extracted position, i.e. further towards and below the first bearing plate 41. From its intermediate position the folding device 79 is moved into its extracted position, the folding rod 80 folding over the rim strip 124 of the left trouser part 118 upwards, namely about the folding bar 48. Upon this the folding bar 80 gets into a position between the folding bar 48 and the holding bar 47. The bow slider 57 is retracted into its left position, so that the folded-over rim strip 126 is in free position above the associated half 101*a*, as seen in FIG. 31. The sewing machine 2 is now moved from the seam end point P2 to the point P3 which is the seam starting point P3 of the first zip fastener seam 129. The arm 10 and the base plate 11 are tilted to take their position of operation and the first zip fastener seam 129 is sewn from the seam starting point P3 to the upper seam end point P4. This is a straight seam. Thus the zip fastener 97 is attached to the right trouser part 117. At the end point P4 of the first zip fastener seam 129 a thread cutting operation takes place and the arm 10 is lifted and the base plate 11 is lowered. Then the sewing machine 2 is moved from the seam end point P4 to a point P5 outside the sewing field.

Still by way of sequence control the folding device 79 is lifted by the correspondingly programmed electronic data processing unit 13 and moved into its retracted position. Thus the folding rod 80 is lifted off the folded-over rim strip 124 lying on top of the second trouser part 118 and the rim strip 124 is further folded over and positioned to overlap the second half 101*b* of the zip fastener 97.

When the second zip fastener seam 130 is to be sewn especially spaced apart from the first zip fastener seam 129, then the seam width slider 103 is by this time moved into its retracted position. However, the ensuring description and the corresponding graphic representations proceed from that this is not the case.

Figure 28:
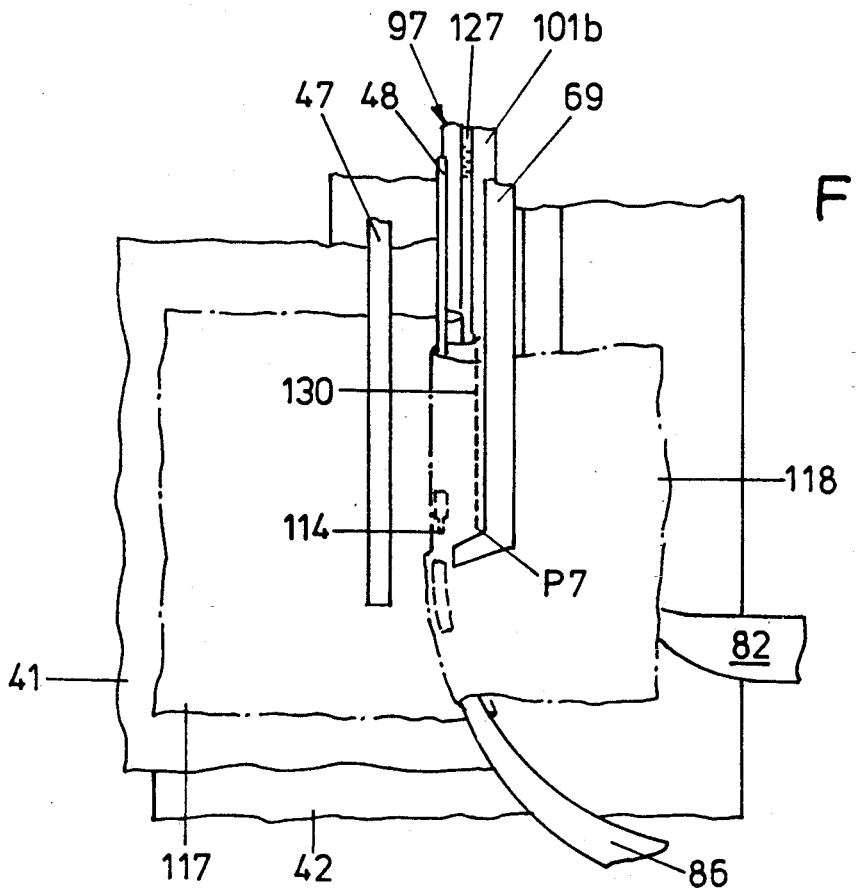
FIG. 28 shows the workpiece holder in a further operating stage, in which the left trouser part has been thrown over and a substantial part of a second zip fastener seam has been sewn.
Figure 29:
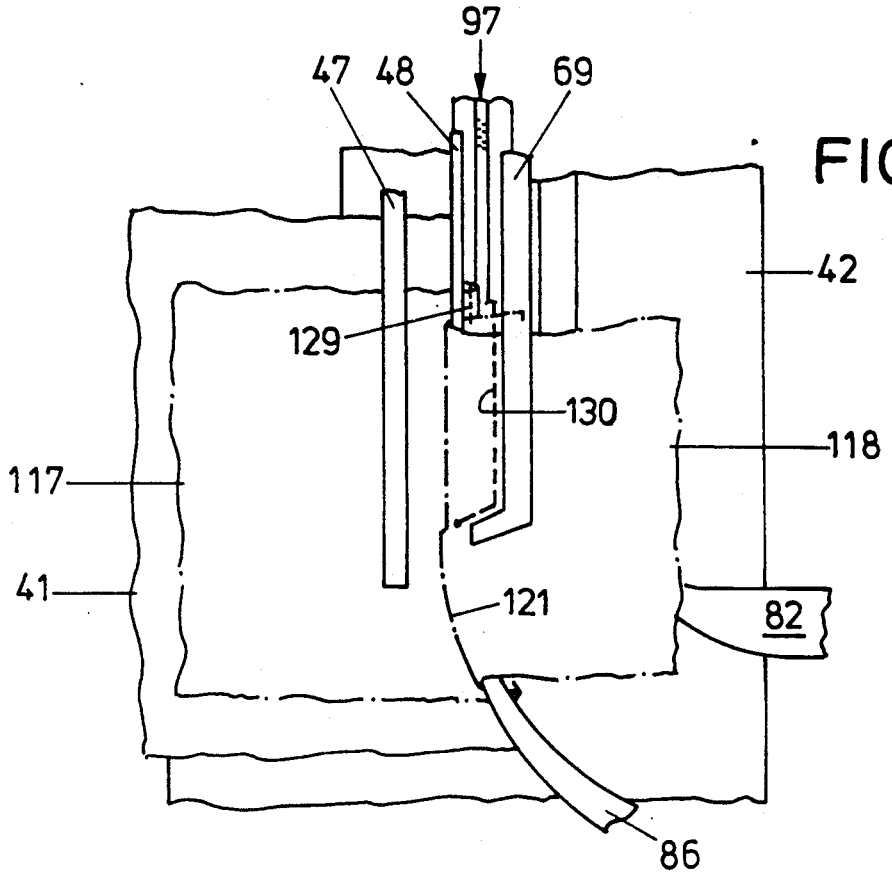
FIG. 29 shows a final operating stage of the workpiece holder, in which the second zip fastener seam has been finished.

By way of sequence control the cloth slider 68 is now moved back into its central position, in which the cloth slider rod 69 is in a position approximately on the abutment bar 107 of the seam width slider 103, so that between the teeth 127 of the zip fastener 97 and the cloth slider rod 69 sufficient free space is available above the half 101*b*, through which the second zip fastener seam 130 can be sewn. During this the left trouser part 118 is folded over about the folding bar 48, as can be seen from FIG. 28 and FIG. 31, i.e. a zip fastener covering strip 139, a so-called outer fly is thus produced. By tilting the thrower device 63 into its retracted position the left trouser part 118 is thrown in the direction towards the second bearing plate 42, so that only the double zip fastener covering strip 139 is located above the corresponding half 101*b* of the zip fastener 97. The left trouser part 118 thrown over now bears against the outer trouser inseam bar 86; thus the placing of the trouser parts 117, 118 is fixed also in this position. Then and still by way of sequence control the sewing machine 2 is moved from the position P5 towards the seam starting position P6 for the second zip fastener seam 130. There the arm 10 is lowered and the base plate 11 is lifted and then the straight part of the second zip fastener seam 130 is sewn from the seam starting point P6 to the position P7, i.e. an intermediate point. This is ahead of a bent off end piece 140 of the cloth slider rod 69, this end piece being bent off in the direction towards the end of the folding bar 48. The outer trouser inseam bar 86 is moved in y direction towards the operator's side 46, so that the coupling between the folding bar 48 and the outer trouser inseam bar 86 is released, as can be seen in FIG. 28. Then the lower part of the second zip fastener seam 130 is finished, sewing taking place from the position P7 to the seam end point P8. This is enabled by an oblique slit 141 in the second workpiece bearing plate 42 leading from the zip fastener nest 96 into an area corresponding to the seam end point P8. The bent off end piece 140 of the cloth slider bar 69 is located in the vicinity of a rim of this oblique slit 141. In this case sewing takes place beyond the starting area of the first zip fastener seam 129 in the vicinity of the seam starting point P3 right into the area of the trouser inseam 121 in the vicinity of its seam end point P2. Here a thread cut-off operation takes place. The arm 10 is lifted and the base plate 11 is lowered. The sewing machine 2 is displaced without sewing from the seam end point P8 into the starting position Po.

Still by way of sequence control the outer trouser inseam bar 86 is lifted and moved back into its retracted starting position, as it is shown in FIG. 22. The second workpiece bearing plate 42 is moved into its retracted position to the right. The first workpiece bearing plate 41 is moved into its retracted position to the left. The seam width slider 103 is moved into its retracted position, so that the half 101*b* of the zip fastener 97 retained in it is released to ensure easy removal of the trouser parts 117, 118 from the workpiece holder 32. The drives are set at zero pressure. The operator removes the trouser parts 117, 118 sewn together as described. The initial status as already specified referring to FIGS. 6 and 22 is automatically re-established.

Figure 30:
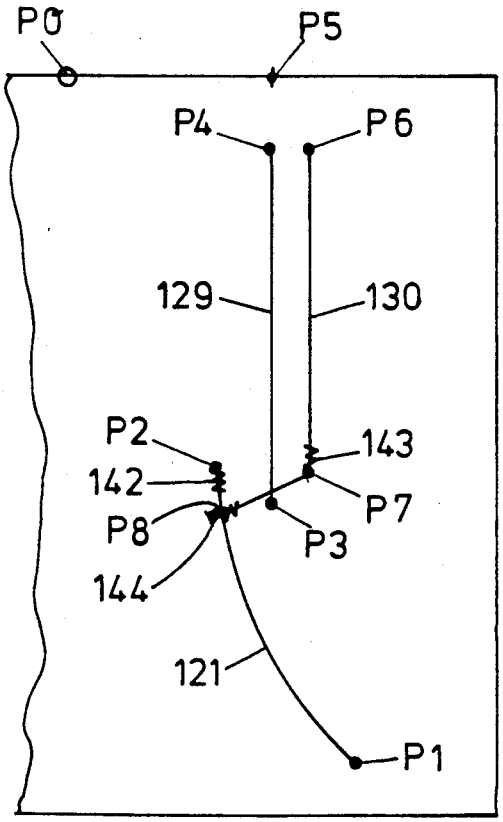
FIG. 30 is a diagrammatic representation of an operating field with the various seams for the sewing of a trouser fly, a lower covering strip not being provided.
Figure 31:
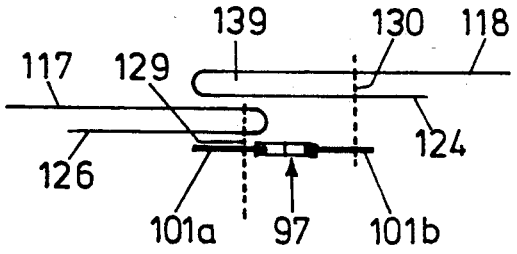
FIG. 31 is a section along the section line XXXI—XXXI in FIG. 21 through the trouser parts sewn together with one another and with a zip fastener.

As outlined in FIG. 30, a seam lock 142 can be formed among others at the seam end point P2 of the front trouser inseam 121, a seam lock 143 can be provided at the intermediate point P7 and as the case may be a seam lock 144 can also be provided at the seam end point P8. They are then sewn each integrated into the corresponding sewing operation.

Figure 32:
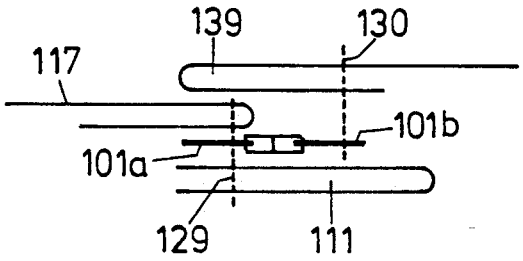
FIG. 32 is a representation corresponding to FIG. 31, however with a lower covering strip.
Figure 33:
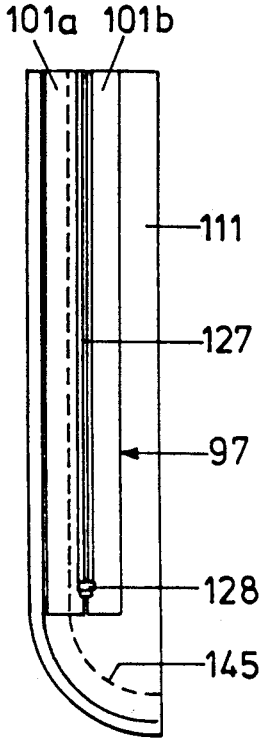
FIG. 33 shows a zip fastener with a lower covering strip.
Figure 34:
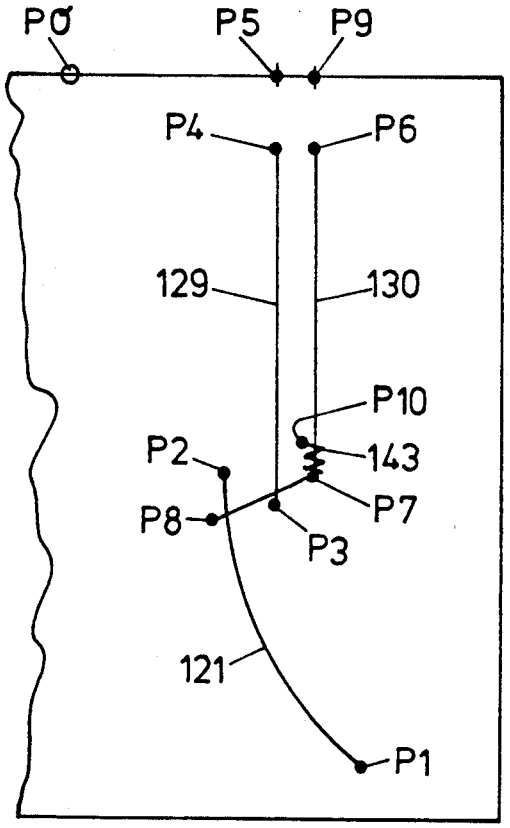
FIG. 34 is a diagrammatic representation of an operating field with the various seams for the sewing of a trouser fly, a lower covering strip being provided.

The sewing-on of a zip fastener 97 shown in FIG. 33 with a lower covering strip 111 also designated as fly placket according to FIG. 34 differs from the above specified method only in the following: Prior to the zip fastener 97 being introduced into the zip fastener nest 96 the supporting slider 108 serving as a folding device for the fly placket is moved into its retracted position. It remains in its retracted position while the front trouser inseam 121 and the first zip fastener seam 129 are sewn. As a result of the rigidity of its own the lower covering strip 111 is located parallel to and under the zip fastener 97, as seen in FIG. 32. The first zip fastener seam 129 is therefore sewn right through the rim strip 126 of the right trouser part 117, the associated half 101*a* of the zip fastener 97 and the lower covering strip 111.

Only immediately prior to the sewing of the second zip fastener seam 130 the supporting slider 108 is moved into its extracted position, whereby the lower covering strip 111 is caught by the advancing bent off edge 112 and folded over into the position shown in FIG. 13, so that the second zip fastener seam 130 can be sewn through the upper covering strip 139 and the associated half 101*b* of the zip fastener without the lower covering strip 111 being sewn through. Apart from this the sewing process illustrated in FIG. 34 is identical with that shown in FIG. 30. To this extent identical reference numerals are used. As seen in FIGS. 34, sewing now takes place from the seam starting point P6 of the second zip fastener seam 130 to the intermediate point P7 without—as already mentioned—the lower covering strip 111 being sewn through. At the intermediate point P7 a thread cut-off operation takes place. Further the arm 10 is lifted and the base plate 11 is lowered. Then the sewing machine 2 drives back in a straight line in y direction to a passing point P9. Now the supporting slider 108 is retracted into the position shown in FIG. 12, the covering strip 111 again taking the position shown in FIG. 32, i.e. the lower covering strip 11 again assumes a position almost parallel to the zip fastener 97 as a result of the rigidity of its own. Subsequently the sewing machine 2 again drives along the already sewn part of the second zip fastener seam 130 to a point P10 in the proximity of the intermediate point P7 and starting from here sews a seam block 143 as far as to the intermediate point P7 over the associated area of the second zip fastener seam 130. From the intermediate point P7 the end of the second zip fastener seam 130 is then sewn as far as to the seam end point P8 in the manner already described. It results from the foregoing that the lower covering strip 111 is sewn up by the seam lock 143 and also by the further sewing operation from the intermediate point P7 to the seam end point P8. For clarification FIG. 33 shows a zip fastener 97 with a lower covering strip 111 already sewn on by means of a seam 145. The pre-sewn unit is then handled as specified.

Figure 35:
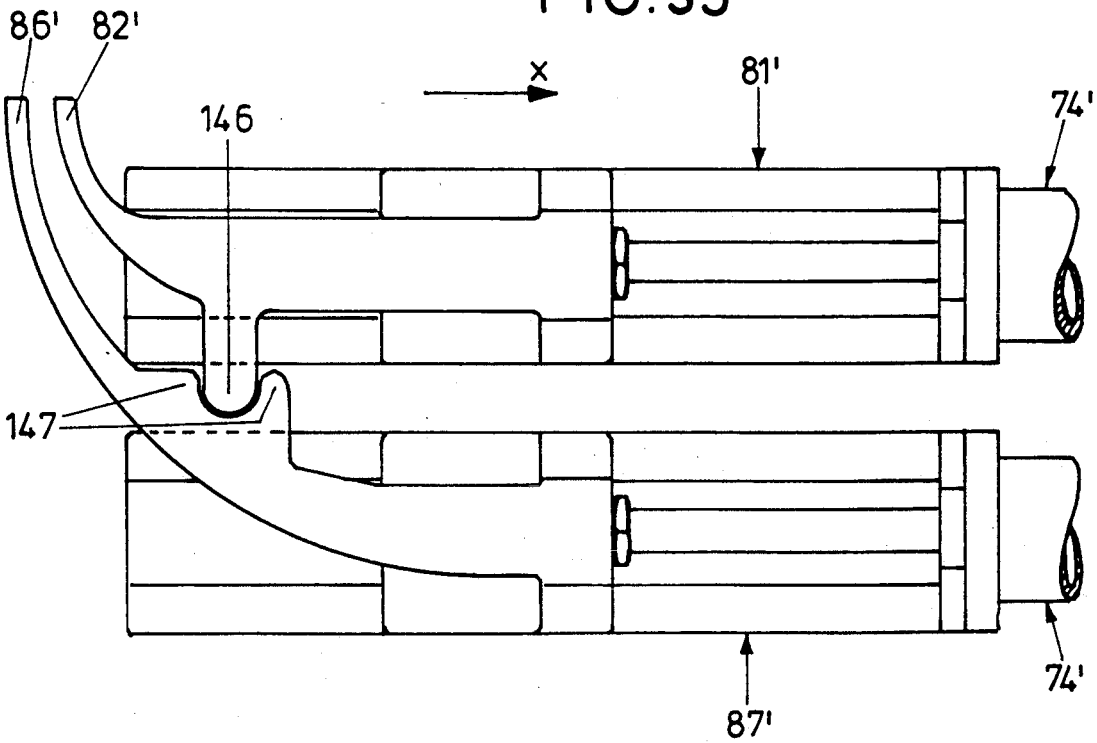
FIG. 35 shows a modified embodiment of a displacing unit.

A modified embodiment of the inner trouser inseam bar 82' and of the outer trouser inseam bar 86' is shown in FIG. 35. A tongue 146 projecting in y direction is arranged on the inner trouser inseam bar 82' and is closely associated with a driver 147 on the outer trouser inseam bar 86'. The sliding drives 74' are in this case not formed by stepping motors with belt drive, but by pneumatically actuatable multi-position piston-cylinder drives, which—as mentioned above—can be used generally. As far as the two trouser inseam bars 82', 86' can be displaced simultaneously, only the sliding drive 74' of the displacing unit 87' of the outer trouser inseam bar 86' is actuated by pressurized air, while the sliding drive 74' of the displacing unit 81' for the inner trouser inseam bar 82' remains at zero pressure. The outer trouser inseam bar 86' therefore drives the inner trouser inseam bar 82' in x direction into its position on the extreme left. After termination of the trouser inseam 121 the inner trouser inseam bar 82' is lifted, the tongue 146 and the driver 147 being disconnected. By actuation of the sliding drive 74' of the displacing unit 81' the inner trouser inseam bar 82' is moved into its retracted position to the extreme right, which corresponds to the position according to FIG. 26. After termination of the second zip fastener seam 130 the outer trouser inseam bar 86' is moved in x direction into its retracted position to the extreme right. Subsequently the tongue 146 and the driver 147 are again brought into engagement with each other by displacement of the outer trouser inseam bar 86' in y direction towards the inner trouser inseam bar 82'.

The exemplary embodiments specified above relate to the sewing of a pair of ladies' trousers 116. If men's trousers are to be sewn, with the zip fastener covering strip 139 and as the case may be the lower covering strip 111 being arranged in opposite direction, the trouser parts 117 and 118 are also to be interchanged correspondingly.

What is claimed is:

1. A method of joining a first trouser part (117) and a second trouser part (118) by sewing a front trouser inseam (121) and by sewing a zip fastener (97) to said first and said second trouser part, comprising the following steps:

a) the zip fastener (97) having a first half (101*a*) and a second half (101*b*) is brought into a predetermined position;

b) the first trouser part (117) turned inside out is positioned relative to the zip fastener (97);

c) the second trouser part (118) turned inside out is put on the first trouser part (117) in a position for sewing of the front trouser inseam (121);

d) the front trouser inseam (121) is sewn;

e) a rim strip (124) of the second trouser part (118) to be attached to the second half (101*b*) of the zip fastener (97) is folded over on to the second trouser part (118), a rim strip (126) of the first trouser part (117) to be attached to the first half (101*a*) of the zip fastener (97) being at least partially uncovered;

f) at least the rim strip (126) of the first trouser part (117) and the zip fastener (97) are being held in place relative to one another;

g) the rim strip (126) of the first trouser part (117) is attached to the first half (101*a*) of the zip fastener (97) by means of a first seam, said seam defining a first zip fastener seam (129);

h) the second trouser part (118) is lifted off the first trouser part (117) and folded over, so that the rim strip (124) of the second trouser part (118) overlaps the second half (101*b*) of the zip fastener (97);

i) at least the rim strip (124) of the second trouser part (118) and the zip fastener (97) are held in place relative to one another;

j) the rim strip (124) of the second trouser part (118) and the second half (101*b*) of the zip fastener (97) are joined by means of a second seam, said seam defining a second zip fastener seam (130), wherein before step "g)" the rim strip (126) of the first trouser part (117) is folded over and wherein the folded-over rim strip (126) is positioned to overlap the first half (101*a*) of the zip fastener (97) and is attached to said first half (101*a*) of the zip fastener (97) by means of the first zip fastener seam (129).

2. A method of joining a first trouser part (117) and a second trouser part (118) by sewing a front trouser inseam (121) and by sewing a zip fastener (97) to said first and said second trouser part, comprising the following steps:

a) the zip fastener (97) having a first half (101*a*) and a second half (101*b*) is brought into a predetermined position;

b) the first trouser part (117) turned inside out is positioned relative to the zip fastener (97);

c) the second trouser part (118) turned inside out is put on the first trouser part (117) in a position for sewing of the front trouser inseam (121);

d) the front trouser inseam (121) is sewn;

e) a rim strip (124) of the second trouser part (118) to be attached to the second half (101*b*) of the zip fastener (97) is folded over on to the second trouser part (118), a rim strip (126) of the first trouser part (117) to be attached to the first half (101*a*) of the zip fastener (97) being at least partially uncovered;

f) at least the rim strip (126) of the first trouser part (117) and the zip fastener (97) are being held in place relative to one another;

g) the rim strip (126) of the first trouser part (117) is attached to the first half (101*a*) of the zip fastener (97) by means of a first seam, said seam defining a first zip fastener seam (129);

h) the second trouser part (118) is lifted off the first trouser part (117) and folded over, so that the rim strip (124) of the second trouser part (118) overlaps the second half (101*b*) of the zip fastener (97);

i) at least the rim strip (124) of the second trouser part (118) and the zip fastener (97) are held in place relative to one another;

j) the rim strip (124) of the second trouser part (118) and the second half (101*b*) of the zip fastener (97) are joined by means of a second seam, said seam defining a second zip fastener seam (130), wherein before step "j)" the rim strip (124) of the second trouser part (118) is further folded over and wherein the further folded-over rim strip (124) is positioned to overlap the second half (101*b*) of the zip fastener (97) and is attached to said second half (101*b*) of the zip fastener (97) by means of the second zip fastener seam (130).

3. A method of joining a first trouser part (117) and a second trouser part (118) by sewing a front trouser inseam (121) and by sewing a zip fastener (97) to said first and said second trouser part, comprising the following steps:

a) the zip fastener (97) having a first half (101*a*) and a second half (101*b*) is brought into a predetermined position;

b) the first trouser part (117) turned inside out is positioned relative to the zip fastener (97);

c) the second trouser part (118) turned inside out is put on the first trouser part (117) in a position for sewing of the front trouser inseam (121);

d) the front trouser inseam (121) is sewn;

e) a rim strip (124) of the second trouser part (118) to be attached to the second half (101*b*) of the zip fastener (97) is folded over on to the second trouser part (118), a rim strip (126) of the first trouser part (117) to be attached to the first half (101*a*) of the zip fastener (97) being at least partially uncovered;

f) at least the rim strip (126) of the first trouser part (117) and the zip fastener (97) are being held in place relative to one another;

g) the rim strip (126) of the first trouser part (117) is attached to the first half (101*a*) of the zip fastener (97) by means of a first seam, said seam defining a first zip fastener seam (129);

h) the second trouser part (118) is lifted off the first trouser part (117) and folded over, so that the rim strip (124) of the second trouser part (118) overlaps the second half (101*b*) of the zip fastener (97);

i) at least the rim strip (124) of the second trouser part (118) and the zip fastener (97) are held in place relative to one another;

j) the rim strip (124) of the second trouser part (118) and the second half (101*b*) of the zip fastener (97) are joined by means of a second seam, said seam defining a second zip fastener seam (130), wherein at least one of the front trouser inseam (121), the first zip fastener seam (129) and the second zip fastener seam (130) is provided with at least one seam lock (142, 143, 144) sewn together with said at least one seam.

4. A method of joining a first trouser part (117) and a second trouser part (118) by sewing a front trouser inseam (121) and by sewing a zip fastener (97) to said first and said second trouser part, comprising the following steps:

a) the zip fastener (97) having a first half (101*a*) and a second half (101*b*) is brought into a predetermined position;

b) the first trouser part (117) turned inside out is positioned relative to the zip fastener (97);

c) the second trouser part (118) turned inside out is put on the first trouser part (117) in a position for sewing of the front trouser inseam (121);

d) the front trouser inseam (121) is sewn;

e) a rim strip (124) of the second trouser part (118) to be attached to the second half (101*b*) of the zip fastener (97) is folded over on to the second trouser part (118), a rim strip (126) of the first trouser part (117) to be attached to the first half (101*a*) of the zip fastener (97) being at least partially uncovered;

f) at least the rim strip (126) of the first trouser part (117) and the zip fastener (97) are being held in place relative to one another;

g) the rim strip (126) of the first trouser part (117) is attached to the first half (101*a*) of the zip fastener (97) by means of a first seam, said seam defining a first zip fastener seam (129);

h) the second trouser part (118) is lifted off the first trouser part (117) and folded over, so that the rim strip (124) of the second trouser part (118) overlaps the second half (101*b*) of the zip fastener (97);

i) at least the rim strip (124) of the second trouser part (118) and the zip fastener (97) are held in place relative to one another;

j) the rim strip (124) of the second trouser part (118) and the second half (101*b*) of the zip fastener (97) are joined by means of a second seam, said seam defining a second zip fastener seam (130), wherein the front trouser inseam (121) is sewn from a seam starting point (P1) remote from the rim strips (124, 126) to a seam end point (P2) adjacent to the rim strips (124, 126), wherein the first zip fastener seam (129) is sewn from a seam starting point (P3) adjacent to the seam end point (P2) of the front trouser inseam (121) to a seam end point (P4) remote from this seam starting point (P3), and wherein the second zip fastener seam (130) is sewn from a seam starting point (P6) adjacent to the seam end point (P4) of the first zip fastener seam (129) to a seam end point (P8) adjacent to the seam end point (P2) of the front trouser inseam (121).

5. A method of joining a first trouser part (117) and a second trouser part (118) by sewing a front trouser inseam (121) and by sewing a zip fastener (97) to said first and said second trouser part, comprising the following steps:

a) the zip fastener (97) having a first half (101*a*) and a second half (101*b*) is brought into a predetermined position;

b) the first trouser part (117) turned inside out is positioned relative to the zip fastener (97);

c) the second trouser part (118) turned inside out is put on the first trouser part (117) in a position for sewing of the front trouser inseam (121);

d) the front trouser inseam (121) is sewn;

e) a rim strip (124) of the second trouser part (118) to be attached to the second half (101*b*) of the zip fastener (97) is folded over on to the second trouser part (118), a rim strip (126) of the first trouser part (117) to be attached to the first half (101*a*) of the zip fastener (97) being at least partially uncovered;

f) at least the rim strip (126) of the first trouser part (117) and the zip fastener (97) are being held in place relative to one another;

g) the rim strip (126) of the first trouser part (117) is attached to the first half (101*a*) of the zip fastener (97) by means of a first seam, said seam defining a first zip fastener seam (129);

h) the second trouser part (118) is lifted off the first trouser part (117) and folded over, so that the rim strip (124) of the second trouser part (118) overlaps the second half (101*b*) of the zip fastener (97);

i) at least the rim strip (124) of the second trouser part (118) and the zip fastener (97) are held in place relative to one another;

j) the rim strip (124) of the second trouser part (118) and the second half (101*b*) of the zip fastener (97) are joined by means of a second seam, said seam defining a second zip fastener seam (130), wherein the front trouser inseam (121) is sewn from a seam starting point (P1) remote from the rim strips (124, 126) to a seam end point (P2) adjacent to the rim strips (124, 126), wherein the first zip fastener seam (129) is sewn from a seam starting point (P3) adjacent to the seam end point (P2) of the front trouser inseam (121) to a seam end point (P4) remote from this seam starting point (P3), and wherein said zip fastener (97) is provided with a lower covering strip (111).

6. A method according to claim 5, wherein the second zip fastener seam (130) is sewn from a seam starting point (P6) adjacent to the seam end point (P4) of the first zip fastener seam (129) to an intermediate point (P7) while the lower covering strip (111) is bent away from the zip fastener (97), wherein the lower covering strip (111) is then bent towards the zip fastener (97), and wherein subsequently the second zip fastener seam (130) is sewn from a point adjacent to the intermediate point (P7) to a seam end point (P8) adjacent to the seam end point (P2) of the front trouser inseam (121) through the lower covering strip (111).

7. A sewing unit for joining a first trouser part and a second trouser part by sewing a front trouser inseam and by sewing a zip fastener to said first and said second trouser part, the sewing unit comprising:

a) a sewing machine (2) with a needle (18);

b) a workpiece holder (32, 33), the sewing machine (2) and the workpiece holder (32, 33) being displaceable relative to each other;

c) the workpiece holder (32, 33) has at least one workpiece bearing plate (41, 42);

d) the workpiece holder (32, 33) has a zip fastener nest (96);

e) a holding bar (47) is provided on the workpiece holder (32, 33) and is displaceable between a first position lifted off the workpiece bearing plate (41) and a second position resting on the workpiece bearing plate (41) to hold in place the first trouser part (117) on the workpiece bearing plate (41);

f) a first opening (85) is formed in the workpiece bearing plate (42) for said needle (18) to sew the front trouser inseam (129);

g) the workpiece holder (32, 33) is provided with a trouser inseam bar (82, 86; 82', 86') displaceable between a retracted first position and a second position in which second position it rests on the workpiece bearing plate (42) in the vicinity of an edge (84, 89) of said first opening (85);

h) a folding device (79) is provided on the workpiece holder (32, 33) and is displaceable from a retracted first position into a central second position and from this second position for folding over a rim strip (124) of the second trouser part (118) into a completely extracted third position;

i) the workpiece holder (32, 33) has a device (48) for holding in plate the first trouser part (117) in the vicinity of a rim of the zip fastener nest (96);

j) a thrower device (63) is positioned on the workpiece holder (32, 33), which thrower device (63) is displaceable between a retracted first position and a second position in which second position the thrower device (63) rests on the workpiece bearing plate (41), and which thrower device (63) is displaceable from the second position into the first position for lifting the second trouser part (118) off the first trouser part (117) and for folding over the second trouser part (118);

k) a device is provided on the workpiece holder (32, 33) for pressing the second trouser part (118) in the vicinity of a rim of the zip fastener nest (96) in a direction towards the workpiece bearing plate (42).

8. A sewing unit according to claim 7, wherein the workpiece holder (32, 33) has a first workpiece bearing plate (41) and a second workpiece holding plate (42), which first and second workpiece holding plates (41, 42) are each displaceable between a retracted first position and an extracted second position in an identical direction (x direction) and which first and second workpiece holding plates (41, 42) at least in said second position partially overlap each other, at least the first workpiece bearing plate (41) located above the second workpiece bearing plate (42) being thin.

9. A sewing unit according to claim 8, wherein the holding bar (47) is affixed to the first workpiece bearing plate (41).

10. A sewing unit according to claim 9, wherein the folding bar (48) is positioned to a first workpiece bearing plate (41) of two workpiece bearing plates (41, 42).

11. A sewing unit according to claim 8, wherein the zip fastener nest (96) is formed in the second workpiece bearing plate 42.

12. A sewing unit according to claim 11, wherein an edge (133*a*) of the first workpiece bearing plate (41) and the second workpiece bearing plate (42) each in said first position define a second opening (133) adjacent to the zip fastener nest (96), and wherein the first workpiece bearing plate (41) in said second position covers the second opening (133).

13. A sewing unit according to claim 12, wherein a bow slider (57) is arranged on the first workpiece bearing plate (41) and is displaceable between a first position located behind said edge (133*a*) of the first workpiece bearing plate (41) and below the first workpiece bearing plate (41) and a second position projecting into the second opening (133).

14. A sewing unit according to claim 12, wherein in the second position of the second workpiece bearing plate (42) said edge (133*a*) of the first workpiece bearing plate (41) is adjacent to the zip fastener nest (96).

15. A sewing unit according to claim 7, wherein a folding bar (48) is provided on the workpiece holder (32, 33) and is displaceable between a first position lifted off the at least one workpiece bearing plate (41) and a second position resting on the at least one workpiece bearing plate (41), and wherein the folding device (79) is movable over the folding bar (48) from said second position into said third position.

16. A sewing unit according to claim 15, wherein the device for pressing the second trouser part (118) in the vicinity of the rim of the zip fastener nest (96) in the direction towards the at least one workpiece bearing plate (42) is formed as a cloth slider (68), which is displaceable between a retracted first position, a second position, in which it presses the second trouser part (118) towards the at least one workpiece bearing plate (42), and a third position, in which seen from the zip fastener nest (96) it is located behind the folding bar (48) and from which it is movable over the folding bar (48) into the second position.

17. A sewing unit according to claim 15, wherein at least one coupling element is provided on the at least one trouser inseam bar (82, 86; 82', 86') and wherein one coupling element is provided on the folding bar (48), which coupling elements are engageable with each other.

18. A sewing unit according to claim 17, wherein the at least one trouser inseam bar (82') is displaceable into a third position, in which it is at a distance from the folding bar (48).

19. A sewing unit according to claim 7, wherein an inner trouser inseam bar (82; 82') is provided, which in its second position is putable on the workpiece bearing plate (42) in the vicinity of an inside edge (84) of the first opening (85), and wherein an outer trouser inseam bar (86, 86') is provided, which in its second position is putable on the workpiece bearing plate in the vicinity of an outside edge (89) of the first opening (85).

20. A sewing unit according to claim 19, wherein the inner trouser inseam bar (82') in its first position and the outer trouser inseam bar (86') in its first position are coupled with one another by form locking and wherein the inner trouser inseam bar (82') in its second position and the outer trouser inseam bar (86') in its second position are coupled with one another by form locking.

21. A sewing unit according to claim 20, wherein the at least one trouser inseam bar (82') is displaceable into a third position, in which third position the at least one trouser inseam bar (82') is at a distance from the folding bar (48) and wherein in the third position of the outer trouser inseam bar (86') and in the second position of the inner trouser inseam bar (82') the trouser inseam bars (82',86') are disconnected.

22. A sewing unit according to claim 7, wherein the zip fastener nest (96) has a first retainer (99) for the first half (101*a*) of the zip fastener (97) and a second retainer (100) for the second half (101*b*) of the zip fastener (97), and wherein the second retainer (100) is provided in a seam width slider (103), which seam width slider (103) is displaceable between a first position, in which first position the second retainer (100) is adjacent to the first retainer (99), and a second position, in which second position the second retainer (100) is remote from the first retainer (99).

23. A sewing unit according to claim 7, wherein a supporting slider (108) is provided, displaceable from a retracted first position below the at least one workpiece bearing plate (42) into an extracted second position below the zip fastener nest (96).

24. A sewing unit according to claim 7, wherein the workpiece holder (32, 33) is stationary and the sewing machine (2) is movable in two directions of displacement one at right angles relative to the other (x direction and y direction).

25. A sewing unit according to claim 7, wherein the sewing machine (2) has an upper arm (10) tiltable upwards and a base plate (11) tiltable downwards.

* * * * *